US008308550B2

(12) United States Patent
Filipour et al.

(10) Patent No.: US 8,308,550 B2
(45) Date of Patent: Nov. 13, 2012

(54) GAMING SYSTEMS, GAMING DEVICES AND METHODS PROVIDING TIME BASED GAME SESSIONS WITH CHANGING VALUES

(75) Inventors: Cameron A. Filipour, Las Vegas, NV (US); Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 241 days.

(21) Appl. No.: 12/774,048

(22) Filed: May 5, 2010

(65) Prior Publication Data

US 2011/0275427 A1 Nov. 10, 2011

(51) Int. Cl.
*A63F 9/24* (2006.01)

(52) U.S. Cl. ..... 463/20

(58) Field of Classification Search ..... 463/16–42; 273/292, 138.1

See application file for complete search history.

(56) References Cited

U.S. PATENT DOCUMENTS

| | | | |
|---|---|---|---|
| 5,344,144 | A | 9/1994 | Canon |
| 6,110,043 | A | 8/2000 | Olsen |
| 6,146,273 | A | 11/2000 | Olsen |
| 6,179,711 | B1 | 1/2001 | Yoseloff |
| 6,210,275 | B1 | 4/2001 | Olsen |
| 6,210,891 | B1 | 4/2001 | Olsen |
| 6,312,334 | B1 | 11/2001 | Yoseloff |
| 6,328,649 | B1 | 12/2001 | Randall et al. |
| 6,435,511 | B1 | 8/2002 | Vancura et al. |
| 6,454,651 | B1 | 9/2002 | Yoseloff |
| 6,471,208 | B2 | 10/2002 | Yoseloff et al. |
| 6,569,015 | B1 | 5/2003 | Baerlocher et al. |
| 6,582,306 | B1 | 6/2003 | Kaminkow |
| 6,638,164 | B2 | 10/2003 | Randall et al. |
| 6,645,075 | B1 | 11/2003 | Gatto et al. |
| 6,669,559 | B1 | 12/2003 | Baerlocher et al. |
| 6,692,355 | B2 | 2/2004 | Baerlocher et al. |
| 6,726,565 | B2 | 4/2004 | Hughs-Baird |
| 6,796,904 | B2 | 9/2004 | Yoseloff |
| 6,971,954 | B2 | 12/2005 | Randall et al. |
| 7,029,395 | B1 | 4/2006 | Baerlocher |
| 7,070,505 | B2 | 7/2006 | Vancura et al. |
| 7,144,011 | B2 | 12/2006 | Asher et al. |
| 7,247,092 | B2 | 7/2007 | Jarvis et al. |
| 7,250,001 | B2 | 7/2007 | Baerlocher et al. |
| 7,258,611 | B2 | 8/2007 | Bigelow, Jr. et al. |
| 7,297,059 | B2 | 11/2007 | Vancura et al. |

(Continued)

OTHER PUBLICATIONS

Letter from Marvin A. Motsenbocker of Mots Law dated Jan. 10, 2012 regarding Third Party Submission in Published Application Under 37 C.F.R. 1.99 filed for U.S. Appl. No. 12/774,048 (1 page).

(Continued)

*Primary Examiner* — Masud Ahmed

(74) *Attorney, Agent, or Firm* — Neal, Gerber & Eisenberg LLP

(57) ABSTRACT

Various embodiments of the present disclosure are generally directed to gaming systems, gaming devices and methods that provide time based game sessions that each include a plurality of wagering events, wherein if one of the plurality of wagering events results in or is associated with a designated change outcome, a value associated with an element or function in the game session (such as a value associated with an outcome, a time value, or a wager amount) changes (such as by increasing) for a remaining portion of the game session (such as the rest of the gaming session).

20 Claims, 20 Drawing Sheets

U.S. PATENT DOCUMENTS

| | | | | |
|---|---|---|---|---|
| 7,306,518 | B2 | 12/2007 | Hughs-Baird et al. | |
| 7,326,115 | B2 | 2/2008 | Baerlocher | |
| 7,329,179 | B2 | 2/2008 | Baerlocher | |
| 7,331,863 | B2 | 2/2008 | Baerlocher | |
| 7,338,370 | B2 | 3/2008 | Oles et al. | |
| 7,351,146 | B2 | 4/2008 | Kaminkow | |
| 7,387,570 | B2 | 6/2008 | Randall | |
| 7,465,227 | B2 | 12/2008 | Baerlocher | |
| 7,470,184 | B2 | 12/2008 | Baerlocher et al. | |
| 7,470,185 | B2 | 12/2008 | Baerlocher | |
| 7,488,247 | B2 | 2/2009 | Hughs-Baird et al. | |
| 7,488,248 | B2 | 2/2009 | Hughs-Baird et al. | |
| 7,488,249 | B2 | 2/2009 | Hughs-Baird et al. | |
| 7,488,251 | B2 | 2/2009 | Kaminkow | |
| 7,666,093 | B2 | 2/2010 | Lafky et al. | |
| 7,713,120 | B2 | 5/2010 | Cannon | |
| 8,075,396 | B2 * | 12/2011 | Roemer | 463/29 |
| 2002/0151354 | A1 | 10/2002 | Boesen et al. | |
| 2003/0144053 | A1 | 7/2003 | Michaelson | |
| 2003/0236115 | A1 | 12/2003 | Chamberlain | |
| 2004/0063492 | A1 | 4/2004 | Baerlocher et al. | |
| 2004/0102238 | A1 * | 5/2004 | Taylor | 463/16 |
| 2004/0177007 | A1 | 9/2004 | Van Luchene | |
| 2004/0204218 | A1 | 10/2004 | Hughs-Barid | |
| 2004/0204229 | A1 | 10/2004 | Walker et al. | |
| 2004/0219969 | A1 | 11/2004 | Casey et al. | |
| 2004/0259625 | A1 | 12/2004 | Randall | |
| 2005/0037839 | A1 | 2/2005 | Yoseloff | |
| 2005/0054416 | A1 | 3/2005 | Hostetler et al. | |
| 2005/0054429 | A1 | 3/2005 | Baerlocher et al. | |
| 2005/0060050 | A1 | 3/2005 | Baerlocher | |
| 2005/0170876 | A1 | 8/2005 | Masci et al. | |
| 2005/0282625 | A1 | 12/2005 | Nicely | |
| 2006/0030399 | A1 | 2/2006 | Baerlocher | |
| 2006/0128457 | A1 | 6/2006 | Cannon | |
| 2006/0142077 | A1 | 6/2006 | Miles et al. | |
| 2007/0054726 | A1 | 3/2007 | Muir et al. | |
| 2007/0202943 | A1 | 8/2007 | Thomas | |
| 2007/0281778 | A1 | 12/2007 | Bigelow, Jr. et al. | |
| 2008/0039191 | A1 | 2/2008 | Cuddy | |
| 2008/0090651 | A1 | 4/2008 | Baerlocher | |
| 2008/0102934 | A1 | 5/2008 | Tan | |
| 2008/0108406 | A1 | 5/2008 | Oberberger | |
| 2008/0108410 | A1 | 5/2008 | Baerlocher et al. | |
| 2008/0108423 | A1 | 5/2008 | Benbrahim et al. | |
| 2008/0108425 | A1 | 5/2008 | Oberberger | |
| 2008/0108430 | A1 | 5/2008 | Evans | |
| 2008/0108431 | A1 | 5/2008 | Cuddy et al. | |
| 2008/0113759 | A1 | 5/2008 | Baerlocher | |
| 2008/0113779 | A1 | 5/2008 | Cregan | |
| 2008/0119283 | A1 | 5/2008 | Baerlocher | |
| 2008/0132320 | A1 | 6/2008 | Rodgers | |
| 2008/0132325 | A1 | 6/2008 | Oles et al. | |
| 2008/0139272 | A1 | 6/2008 | Toyoda | |
| 2008/0153584 | A1 | 6/2008 | Cuddy et al. | |
| 2008/0182650 | A1 | 7/2008 | Randall et al. | |
| 2008/0182655 | A1 | 7/2008 | DeWaal et al. | |
| 2008/0194316 | A1 | 8/2008 | Baerlocher | |
| 2008/0214255 | A1 | 9/2008 | Jarvis et al. | |
| 2008/0214280 | A1 | 9/2008 | Baerlocher | |
| 2008/0268946 | A1 * | 10/2008 | Roemer | 463/27 |
| 2008/0300050 | A1 | 12/2008 | Tessmer et al. | |
| 2008/0318668 | A1 | 12/2008 | Ching et al. | |
| 2009/0017900 | A1 | 1/2009 | Fujimoto et al. | |
| 2009/0042638 | A1 | 2/2009 | Thomas | |
| 2009/0042645 | A1 | 2/2009 | Graham et al. | |
| 2009/0061991 | A1 | 3/2009 | Popovich et al. | |
| 2009/0061997 | A1 | 3/2009 | Popovich et al. | |
| 2009/0061998 | A1 | 3/2009 | Popovich et al. | |
| 2009/0061999 | A1 | 3/2009 | Popovich et al. | |
| 2009/0069073 | A1 | 3/2009 | Gerrard et al. | |
| 2009/0088244 | A1 | 4/2009 | Nicely et al. | |
| 2009/0088253 | A1 | 4/2009 | Oberberger et al. | |
| 2009/0104959 | A1 | 4/2009 | Caputo et al. | |
| 2009/0104977 | A1 | 4/2009 | Zielinski | |
| 2009/0111561 | A1 | 4/2009 | DeWaal et al. | |
| 2009/0111573 | A1 | 4/2009 | Iddings | |
| 2009/0117962 | A1 | 5/2009 | Filipour et al. | |
| 2009/0124326 | A1 | 5/2009 | Caputo et al. | |
| 2009/0124362 | A1 | 5/2009 | Cuddy et al. | |
| 2009/0124363 | A1 | 5/2009 | Baerlocher et al. | |
| 2009/0124364 | A1 | 5/2009 | Cuddy et al. | |
| 2009/0131158 | A1 | 5/2009 | Brunet De Courssou et al. | |
| 2009/0143133 | A1 | 6/2009 | Baerlocher | |
| 2010/0120498 | A1 | 5/2010 | Cuddy et al. | |

OTHER PUBLICATIONS

Third Party Submission in Published Application Under 37 C.F.R. 1.99 filed for U.S. Appl. No. 12/774,048, dated Jan. 10, 2012 (3 pages).

Partially-highlighted U.S. Patent Appl. Pub. No. 2008/0139272 submitted with Third Party Submission in Published Application Under 37 C.F.R. 1.99 for U.S. Appl. No. 12/774,048 (1 page).

Partially-highlighted U.S. Patent Appl. Pub. No. 2009/0017900 submitted with Third Party Submission in Published Application Under 37 C.F.R. 1.99 for U.S. Appl. No. 12/774,048 (1 page).

Letter from Marvin A. Motsenbocker of Mots Law dated Jul. 8, 2011 regarding Third Party Submission in Published Aplpication Under 37 C.F.R. 1.99 filed for U.S. Appl. No. 12/615,837 (1 page).

Third Party Submission in Published Application Under 37 C.F.R. 1.99 filed for U.S. Appl. No. 12/615,837, dated Jul. 8, 2011 (3 pages).

Office Action for U.S. Appl. No. 12/615,837 dated Feb. 29, 2012 (14 pages)

* cited by examiner

FIG. 4

60

| Winning Outcome (62) | Value (64) | Type of Value (66) |
|---|---|---|
| Jacks or Better | 2 | Redistribution |
| Two Pair | 2 | Redistribution |
| Three of a Kind | 3 | Payout |
| Straight | 4 | Payout |
| Flush | 6 | Payout |
| Full House | 9 | Payout |
| Four of a Kind | 25 | Payout |
| Straight Flush | 50 | Payout |
| Royal Flush | 250 | Payout |

| Winning Hand | Value |
|---|---|
| Jacks or Better | 2 (Redistribution) |
| Two Pair | 2 (Redistribution) |
| Three of a Kind | 3 |
| Straight | 4 |
| Flush | 6 |
| Full House | 9 |
| Four of a Kind | 25 |
| Straight Flush | 50 |
| Royal Flush | 250 |

| Winning Hand | Value |
|---|---|
| Jacks or Better | 2 (Redistribution) |
| Two Pair | 2 (Redistribution) |
| Three of a Kind | 3 |
| Straight | 4 |
| Flush | 6 |
| Full House | 9 |
| Four of a Kind | 25 |
| Straight Flush | 50 |
| Royal Flush | 250 |

| Winning Hand | Value |
|---|---|
| Jacks or Better | 2 (Redistribution) |
| Two Pair | 2 (Redistribution) |
| Three of a Kind | 3 |
| Straight | 4 |
| Flush | 8 |
| Full House | 9 |
| Four of a Kind | 25 |
| Straight Flush | 50 |
| Royal Flush | 250 |

| Winning Hand | Value |
|---|---|
| Jacks or Better | 2 (Redistribution) |
| Two Pair | 2 (Redistribution) |
| Three of a Kind | 3 |
| Straight | 4 |
| Flush | 8 |
| Full House | 9 |
| Four of a Kind | 25 |
| Straight Flush | 50 |
| Royal Flush | 250 |

| Winning Hand | Value |
|---|---|
| Jacks or Better | 2 (Redistribution) |
| Two Pair | 2 (Redistribution) |
| Three of a Kind | 3 |
| Straight | 4 |
| Flush | 8 |
| Full House | 9 |
| Four of a Kind | 25 |
| Straight Flush | 50 |
| Royal Flush | 250 |

| Winning Hand | Value |
|---|---|
| Jacks or Better | 2 (Redistribution) |
| Two Pair | 2 (Redistribution) |
| Three of a Kind | 3 |
| Straight | 4 |
| Flush | 8 |
| Full House | 9 |
| Four of a Kind | 25 |
| Straight Flush | 50 |
| Royal Flush | 250 |

| Winning Hand | Value |
|---|---|
| Jacks or Better | 2 (Redistribution) |
| Two Pair | 2 (Redistribution) |
| Three of a Kind | 3 |
| Straight | 4 |
| Flush | 16 |
| Full House | 9 |
| Four of a Kind | 25 |
| Straight Flush | 50 |
| Royal Flush | 250 |

GAMING SYSTEMS, GAMING DEVICES AND METHODS PROVIDING TIME BASED GAME SESSIONS WITH CHANGING VALUES

CROSS REFERENCE TO RELATED APPLICATION

This application is related to the following commonly-owned co-pending U.S. patent application: U.S. patent application Ser. No. 12/615,837, entitled "GAMING SYSTEMS, GAMING DEVICES AND METHODS HAVING TIME BASED GAMES AND MAGNITUDES ASSOCIATED WITH WAGERING EVENTS IN THE TIME BASED GAMES," filed on Nov. 10, 2009.

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

Gaming systems with time based games that enable a player to place a total wager for a game session over a designated period of time are known. However, the methods by which such known gaming systems provide awards during the game sessions are typically limited.

There is a continuing need to provide new and different gaming systems and gaming devices which enable a player to wager for a play of a game for a designated period of time.

SUMMARY

Various embodiments of the present disclosure are generally directed to gaming systems, gaming devices and methods that provide time based game sessions that each include a plurality of wagering events, wherein if one of the plurality of wagering events results in or is associated with a designated change outcome, a value associated with an element or function in the game session (such as a value associated with an outcome, a time value, or a wager amount) changes (such as by increasing) for a remaining portion of the game session (such as the rest of the gaming session).

More specifically, in various embodiments, the gaming system receives a total wager for a game session which will occur over a designated period of time. The game session includes a plurality of wagering events. For each of the plurality of wagering events, the gaming system: (a) determines a portion of the total wager for that wagering event, (b) randomly determines an outcome for that wagering event, (c) displays the randomly determined outcome for that wagering event, and (d) provides the player any awards resulting from that wagering event. Each of the plurality of wagering events can result in any one of a plurality of different outcomes. The plurality of different outcomes include a plurality of different winning outcomes and at least one losing outcome. The gaming system initially associates each of the plurality of different winning outcomes with one of a plurality of different values. At least one, but not all, of the winning outcomes functions as a designated change outcome.

In various embodiments, when that winning outcome or designated change outcome occurs during the gaming session, the gaming system increases one of the values associated with another one of the winning outcomes for the remaining time period of the game session such that if that winning outcome subsequently results from one of the wagering events, an award is provided to the player based at least in part on that increased value associated with that winning outcome and the determined portion of the total wager for that subsequent wagering event. The designated change outcome can occur multiple times during the game session and thus increase the value associated with that winning outcome multiple times during the gaming session. It should also be appreciated that each time that winning outcome occurs for the remaining portion of the game session, an award is provided to the player based at least in part on that increased value and the determined portion of the total wager.

In various embodiments, each of the plurality of different winning outcomes is associated with either a payout value (selected from a plurality of different payout values) or a redistribution value (selected from a plurality of different redistribution values). During a game session, the gaming system displays a plurality of the wagering events. For each of the plurality of wagering events, (i) if the displayed outcome is one of the winning outcomes associated with one of the redistribution values, the gaming system causes that redistribution value (or a value based on that redistribution value) to be added to at least one of the payout values associated with one of the winning outcomes, and (ii) if the displayed outcome is one of the winning outcomes associated with one of the payout values (or changed payout values), the gaming system provides an award to the player based at least in part on the then current payout value and the determined portion of the total wager for that wagering event. The changes made to the payout values (i.e., the increased payout values associated with the winning outcomes) lasts for all subsequent wagering events during the game session in various embodiments. Because the gaming system increases the payout value for subsequent wagering events by adding the redistribution value to the payout value, the gaming system does not provide an award to the player based at least in part on that redistribution value. It should be appreciated that if the winning outcome associated with one of the increased payout values is displayed or obtained multiple times during the game session (i.e., results from multiple wagering events after that payout value has been increased), the gaming system provides an award to the player based at least in part on that increased payout value associated with that winning outcome multiple times. Thus, one advantage of various embodiments of the present disclosure is that once a payout value has been increased an award can be provided to the player based at least in part on that increased payout value multiple times.

In other embodiments, instead of changing the payout value, the gaming system changes or increases a wager or bet amount for subsequent wagering events. In one such embodiment, the gaming system associates at least one of the winning outcomes with a subsequent bet increase value. During a game session, the gaming system displays a plurality of the wagering events and for each of the plurality of wagering events, if the displayed outcome is one of the winning outcomes associated with the subsequent bet increase value, the gaming system randomly determines whether to add the subsequent bet increase value to one of: (i) the total wager, or (ii) the determined portion of the total wager for at least one subsequent wagering event. If the determination is to add the subsequent bet increase value, the gaming system adds the bet increase value to one of: (i) the total wager, or (ii) the determined portion of the total wager. Thus, it should be appreciated that each time a winning outcome associated with a subsequent bet increase value is displayed and the gaming system randomly determines to add the subsequent bet increase value to a subsequent wagering event, the gaming system changes or increases the wager amount for at least one subsequent wagering event. Thus, it should be appreciated that, because the wager amount is increased for at least one subsequent wagering events, if the displayed outcome for that subsequent wagering event is associated with a win credit value, the gaming system references a paytable that determines a larger credit award value to provide the player for that subsequent wagering event.

In other embodiments, instead of changing the payout value or a wager amount, the gaming system changes or increases a time value or an amount of time for the remainder of the game session and provides a number of additional credits. In one such embodiment, the gaming system associates one of the winning outcomes with a time increase value. During a game session, the gaming system displays a plurality of the wagering events and for each of the plurality of wagering events, if the displayed outcome is a winning outcome associated with a time increase value, the gaming system randomly determines whether to add the time value to the designated period of time for the game session. If the determination is to add the time value, the gaming system adds the time value to the designated period of time for the game session. By adding a time increase value to the designated period of time for the game session, the gaming system is configured to enable a player to play the game session for a period of time that is greater than the initial designated period of time for which the player placed the total wager. In addition to providing more time to play the game session, if the displayed outcome is a winning outcome associated with a time increase value, and the gaming system randomly determines to add the time increase value to the designated period of time to play the game session, the gaming system also provides an additional number of credits for subsequent wagering events. This benefits the player because it could provide the player with one or more additional wagering events, and thus could provide the player with awards for each of those additional wagering events.

In other embodiments, the gaming system causes two or more of the winning outcomes to function as a different one of the designated change outcomes. For example, the gaming system associates one of the winning outcomes with a redistribution value and associates one of the winning outcomes with a payout value. The gaming system associates another one of the winning outcomes with a time increase value, and associates another one of the winning outcomes with a subsequent bet increase value. For each of the plurality of different wagering events, if the displayed outcome results in one of the designated change outcomes, the gaming system causes a value associated with an element or function in the game session (such as a value associated with an outcome, a time value, or a wager amount) to change or increase.

Additional features and advantages are described in, and will be apparent from, the following Detailed Description and the figures.

BRIEF DESCRIPTION OF THE FIGURES

FIG. 4 is a paytable of one example of an embodiment of the gaming system disclosed herein in which the gaming system associates winning outcomes with redistribution values and payout values at the beginning of a game session.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
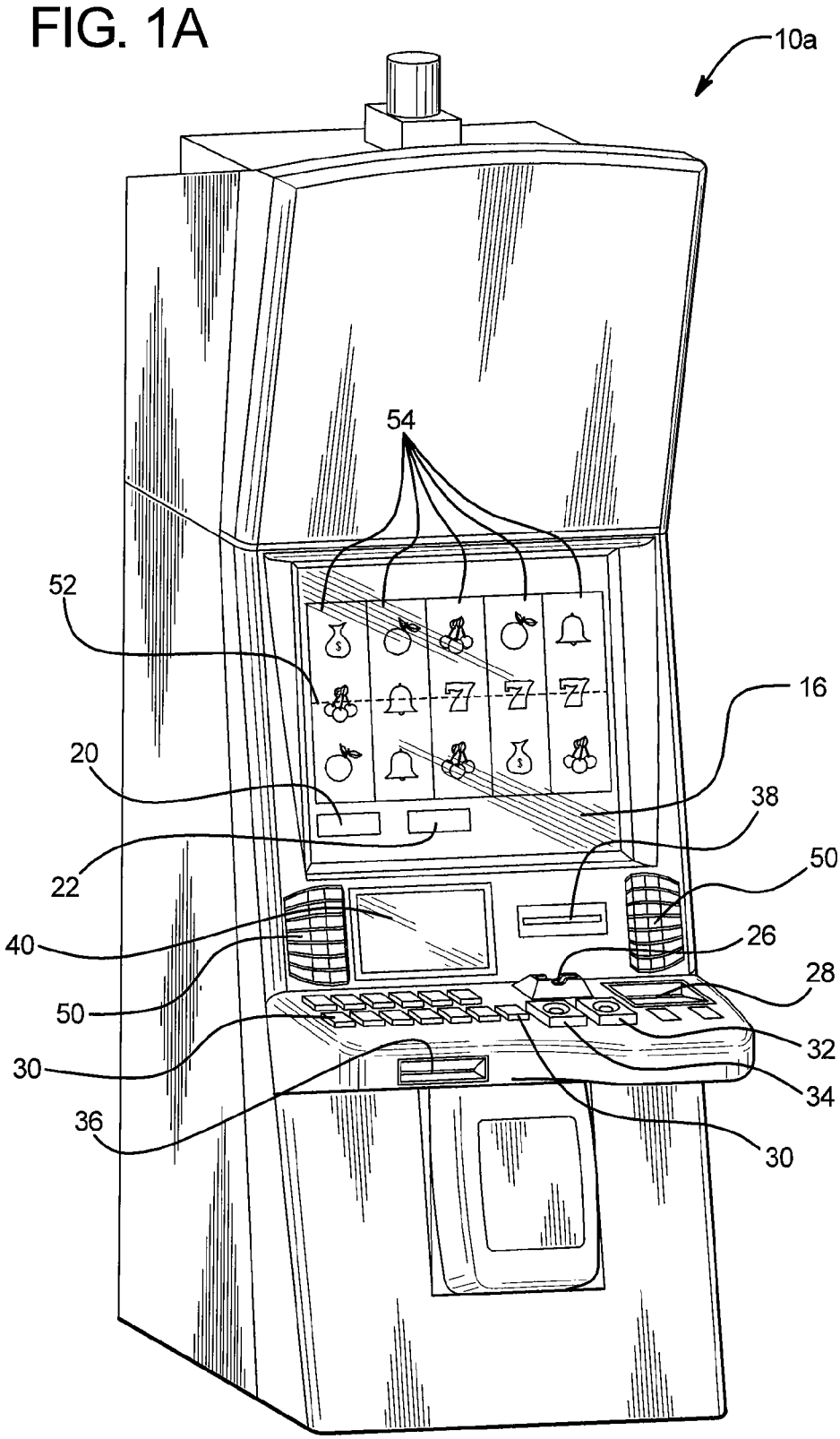
FIGS. 1A and 1B are perspective views of example alternative embodiments of the gaming device of the present disclosure.
Figure 1B:
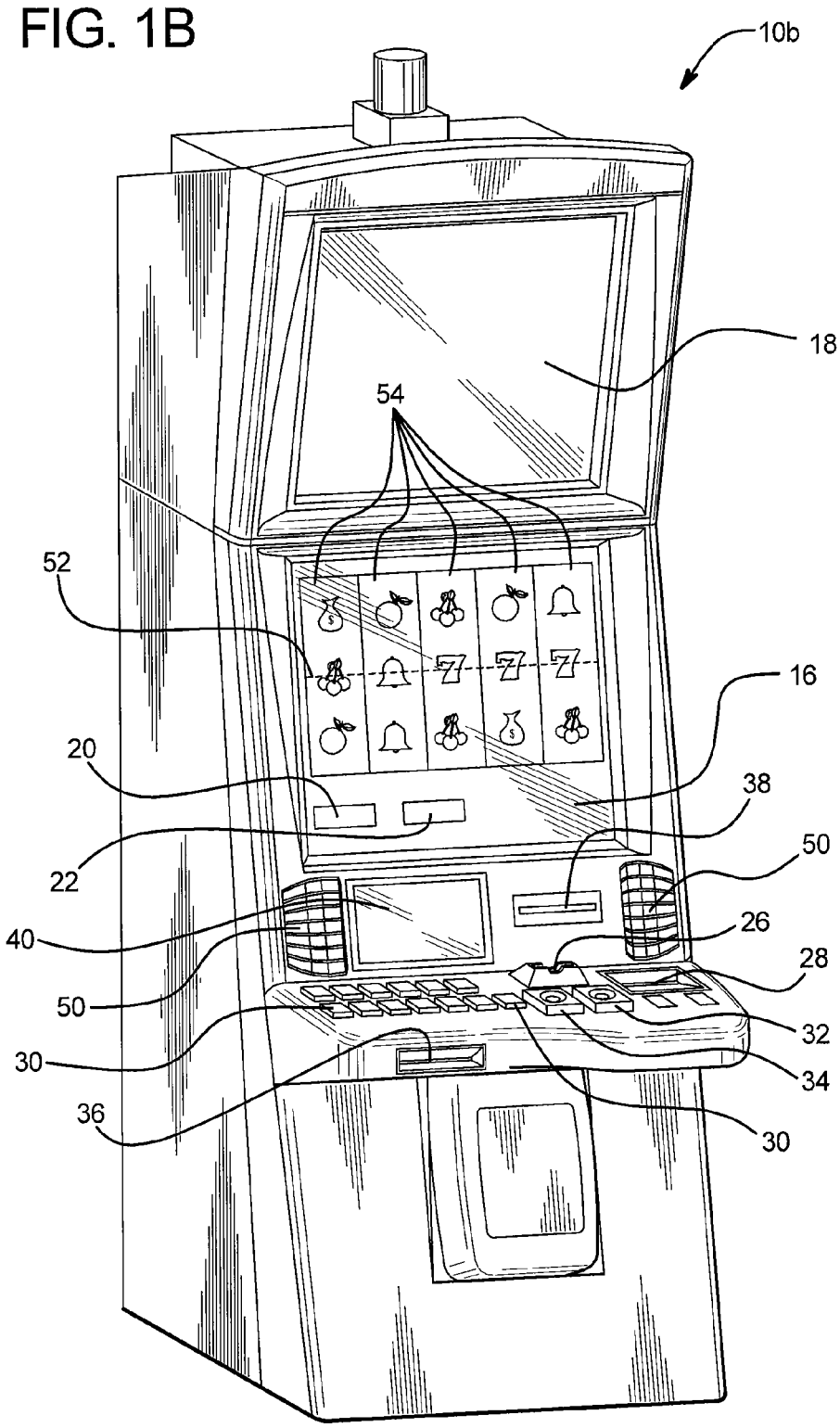

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
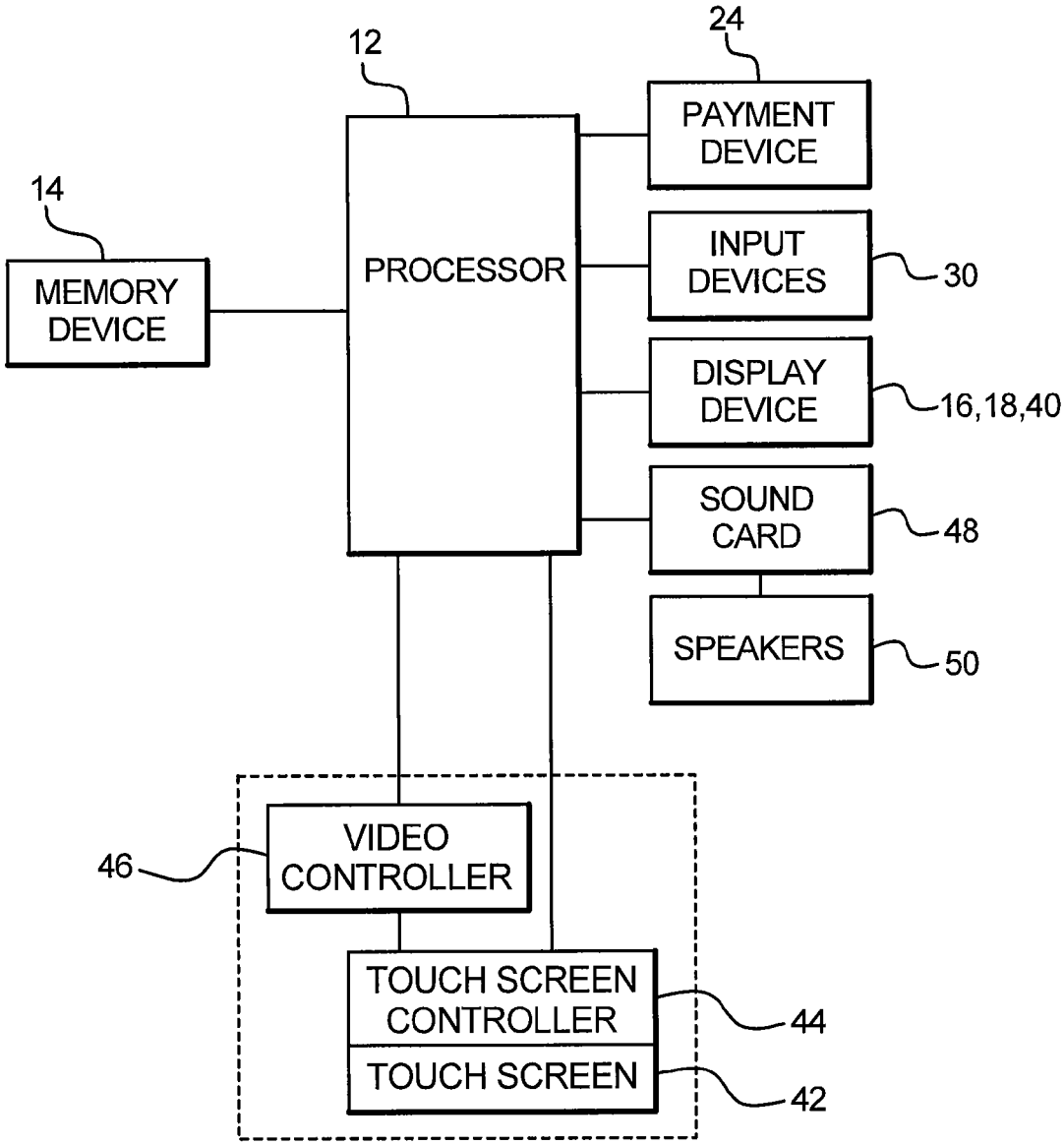
FIG. 2A is a schematic block diagram of one embodiment of an electronic configuration for one of the gaming devices disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
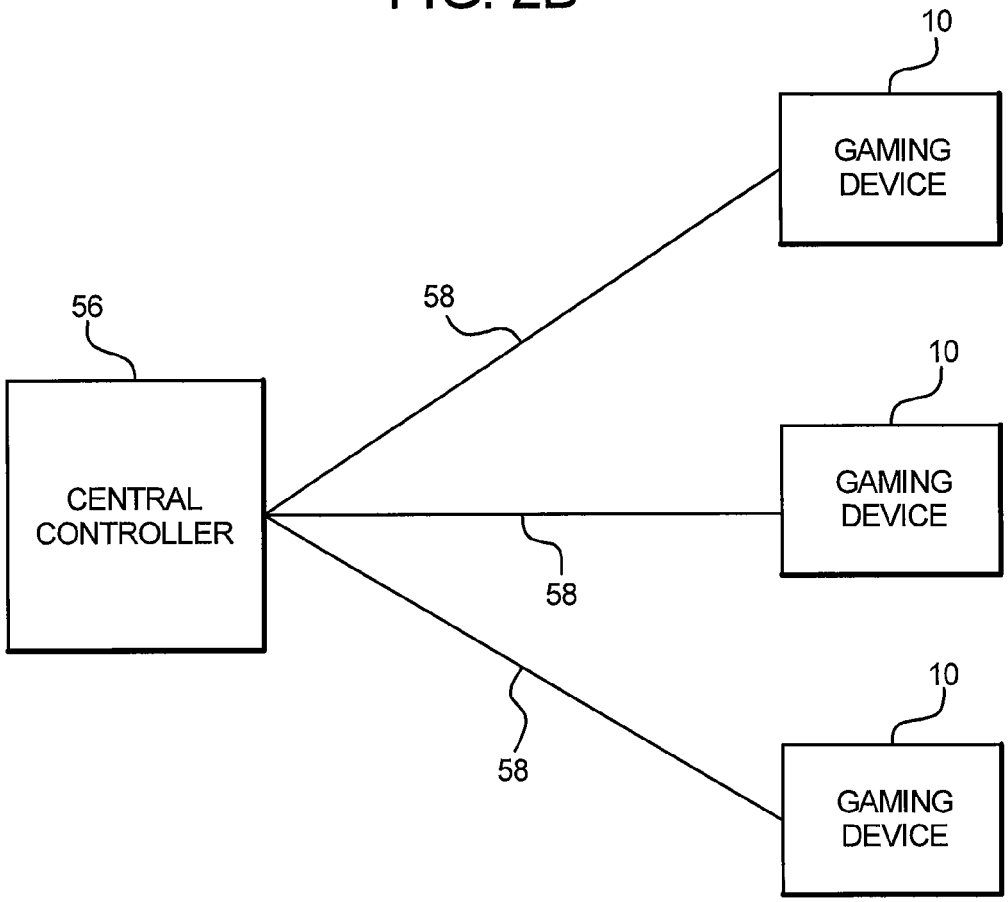
FIG. 2B is a schematic block diagram of one embodiment of a gaming system network configuration including a plurality of gaming devices disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symboldriven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to, win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Time Based Game Sessions with Changing Awards

Various embodiments of the present disclosure are generally directed to gaming systems that provide time based game sessions. The time based game sessions include a plurality of wagering events. If one or more of the plurality of wagering events results in a change outcome as described herein, then a value associated with an outcome, a time value, or a wager amount changes for a remaining portion of the game session.

In one example embodiment, the gaming system receives a total wager for a game session which will occur over a designated period of time. The game session will include a plurality of wagering events. For each of the plurality of wagering events, the gaming system: (a) determines a portion of the total wager for that wagering event, (b) randomly determines an outcome for that wagering event, (c) displays the randomly determined outcome for that wagering event, and (d) provides the player any awards resulting from that wagering event. Each of the plurality of wagering events can result in any one of a plurality of different outcomes. The plurality of different outcomes include a plurality of different winning outcomes and at least one losing outcome. The gaming system initially associates each of the plurality of different winning outcomes with one of a plurality of different values. It should be appreciated that each of the plurality of different values can represent a multiplier factor, which functions to multiply a wager amount for a wagering event in which a particular winning outcome is displayed. At least one, but not all, of the winning outcomes functions as a designated change outcome. When each winning outcome or designated change outcome occurs during the gaming session, the gaming system increases one of the values associated with another one of the winning outcomes for the remaining time period of the game session. If that winning outcome subsequently results from one of the wagering events, the gaming system provides an award to the player based at least in part on the increased value and the determined portion of the total wager for that wagering event. In this embodiment, each of the designated change outcomes can occur multiple times during the game session and each of the winning outcomes can occur multiple times during the game session.

More specifically, this is accomplished in various embodiments, by causing each of the plurality of different winning outcomes to be associated with either a payout value (selected from a plurality of different payout values) or a redistribution value (selected from a plurality of different redistribution values). During a game session, the gaming system displays a plurality of the wagering events. For each of the plurality of wagering events, (i) if the displayed outcome is one of the winning outcomes associated with one of the redistribution values, the gaming system causes that redistribution value (or a value based on that redistribution value) to be added to at least one of the payout values associated with one of the winning outcomes, and (ii) if the displayed outcome is one of the winning outcomes associated with one of the payout values (or changed payout values), the gaming system provides an award to the player based at least in part on that payout value and the determined portion of the total wager for the wagering event. The changes made to the payout values (i.e., the increased payout values associated with the winning outcomes) lasts for all subsequent wagering events during the game session in various embodiments. Because the gaming system increases the payout value for subsequent wagering events by adding the redistribution value to the payout value, the gaming system does not provide an award to the player based on that redistribution value.

Figure 3:
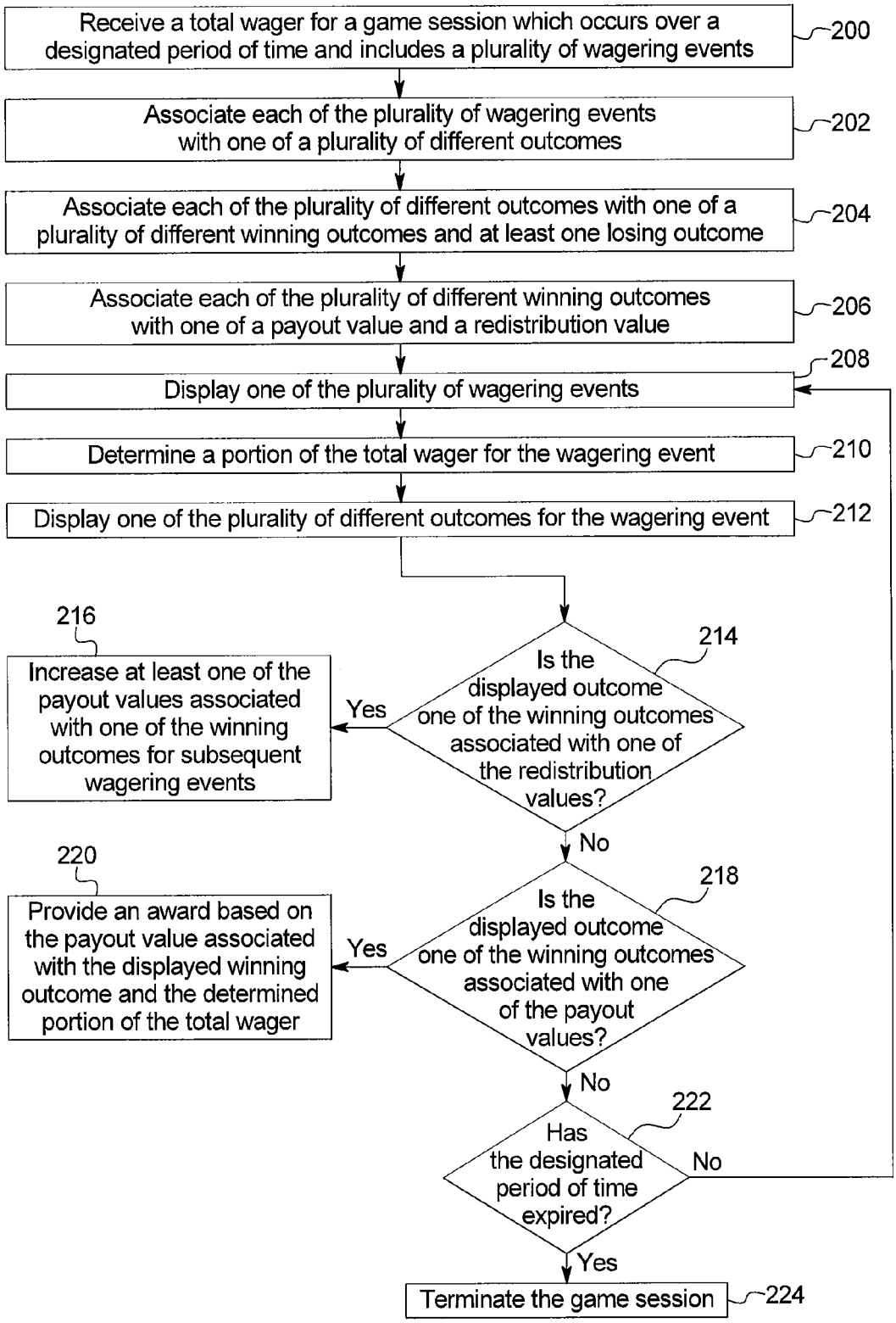
FIG. 3 is a flowchart of one example embodiment of the gaming system disclosed herein which enables a player to place a total wager for a game session over a designated period of time.

FIG. 3 is a flowchart illustrating one such example embodiment of a gaming system configured to enable a player to place a total wager for a game session which occurs over a designated period of time. The gaming system receives a total wager for a game session which includes a plurality of different wagering events and which will occur over a designated period of time as indicated by block 200. The gaming system associates each of the plurality of different wagering events with one of a plurality of different outcomes as indicated by block 202. The gaming system associates each of the plurality of different outcomes with one of a plurality of different winning outcomes and at least one losing outcome as indicated by block 204. The gaming system associates each of the plurality of different winning outcomes with one of a payout value and a redistribution value as indicated by block 206. The gaming system displays one of the plurality of different wagering events as indicated by block 208. The gaming system determines a portion of the total wager for the wagering event as indicated by block 210 and displays one of the plurality of different outcomes as indicated by block 212. The gaming system determines whether the displayed outcome is one of the winning outcomes associated with one of the redistribution values as indicated by diamond 214. If the determination is the displayed outcome is one of the winning outcomes associated with at least one of the redistribution values, the gaming system increases at least one of the payout values associated with one of the winning outcomes for subsequent wagering events as indicated by block 216. If the determination is the displayed winning outcome is not one of the winning outcomes associated with one of the redistribution values, the gaming system determines if the displayed outcome is associated with one of winning outcomes associated with one of the payout values as indicated by diamond 218. If the determination is that the displayed outcome is one of the winning outcomes associated with one of the payout values, the gaming system provides an award based on the payout value associated with the displayed winning outcome and the determined portion of the total wager as indicated by block 220. If the determination is that displayed outcome is not associated with one of the winning outcomes associated with one of the payout values, the gaming system determines whether the designated period of time has expired as indicated by diamond 222. If the determination is that the designated period of time has not expired, the gaming system displays one of the plurality of wagering events. If the determination is the designated period of time has expired, the gaming system terminates the game session as indicated by block 224. It should be appreciated that in various embodiments, the determination of whether the displayed outcome is one of the winning outcomes associated with one of the redistribution values occurs after the determination of whether the displayed outcome is one of the winning outcomes associated with one of the payout values.

In one example embodiment, the gaming system enables a player to place a total wager for a five card draw poker game session for a designated period of time and which will include a plurality of wagering events (i.e., each of the poker hands) as illustrated by FIGS. 5A to 5G. The gaming system initially associates each of a plurality of different winning outcomes 62 with one of a plurality of different values 64, as illustrated by table 60 of FIG. 4. It should be appreciated that in the illustrated embodiment, each of the values 64 can represent a multiplier factor, which can function to multiply a determined portion of the total wager amount for a wagering event in which the gaming system displays one of the winning outcomes, as described in more detail below. Each of the values 64 are associated with a designation or type of value 66, such as a redistribution designation or a payout designation. The plurality of different winning outcomes 62 are the winning outcomes associated with a conventional poker game, such as Jacks or Better, Two Pair, Three of Kind, Straight, Flush, Full House, Four of a Kind, Straight Flush and Royal Flush. The values 64 that are initially associated with each of these winning outcomes are 2, 2, 3, 4, 6, 9, 25, 50 and 250, respectively. The Jacks or Better and Two Pair winning outcomes are associated with redistribution values. Each of the remaining winning outcomes is associated with a payout value.

Figure 5A:
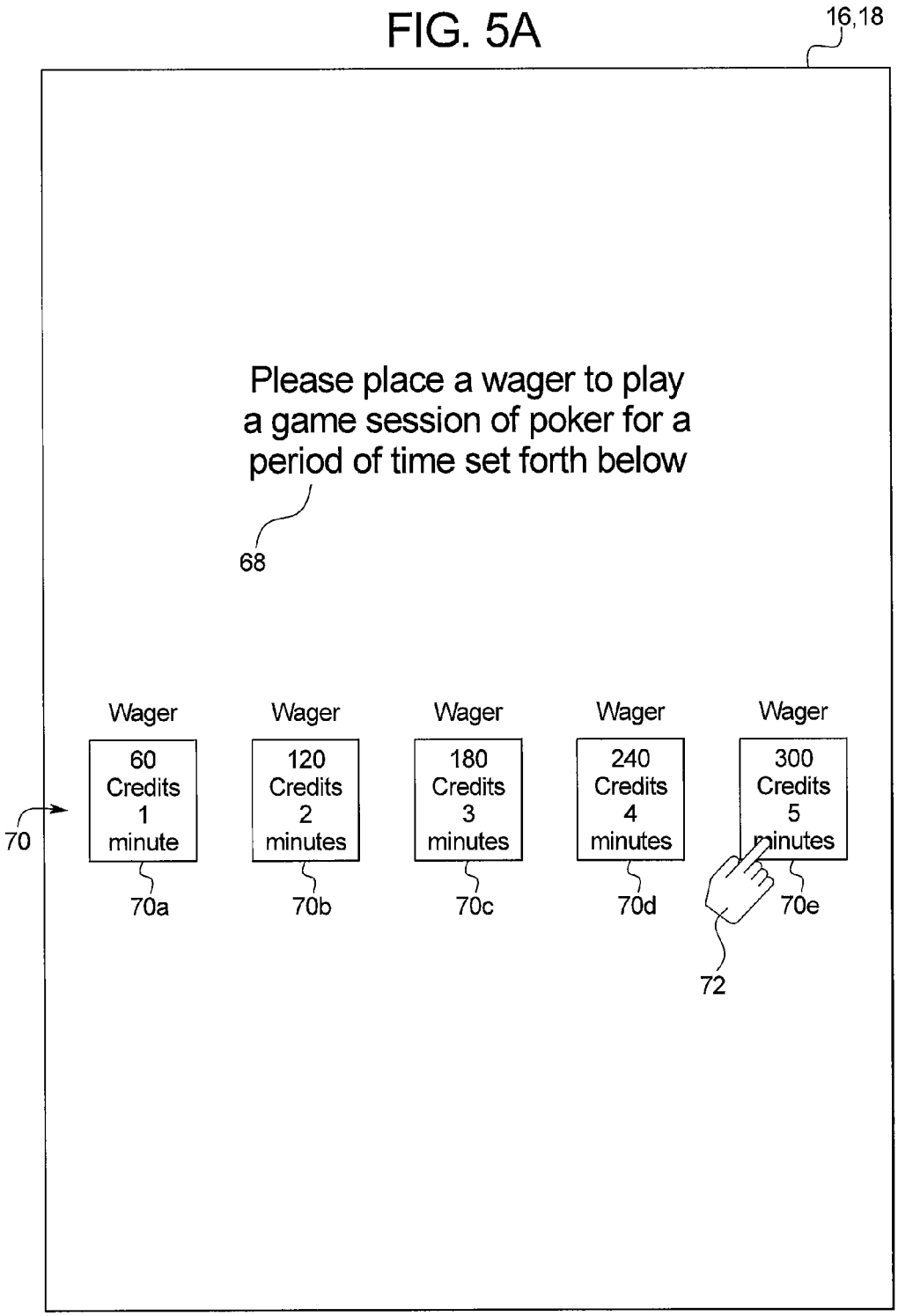
FIGS. 5A, 5B, 5C, 5D, 5E, 5F, 5G, and 5H are front views of a gaming device display providing a play of a game in accordance with an example of an embodiment of the gaming system disclosed herein.

Referring more specifically to FIGS. 5A to 5G, the gaming system first enables the player to place a wager for designated period of time, as illustrated by FIG. 5A. The gaming system displays on display device 16, 18 message 68 of, "PLEASE PLACE A WAGER TO PLAY A GAME SESSION OF POKER FOR A PERIOD OF TIME SET FORTH BELOW." It should be appreciated that in the various embodiments disclosed herein, the gaming system prompts, or messages, could be any suitable type of message or prompt such as an audio, visual or audio/visual prompt. The gaming system also displays different selectable wagering options 70*a*, 70*b*, 70*c*, 70*d* and 70*e*. The gaming system enables the player to select one of the selectable wagering options 70 for the game session. Each selectable wagering option 70 corresponds to a designated period of time for the game session. The longer the period of time the player wishes the game session to occur, the greater number of credits the gaming system requires the player to wager in this illustrated embodiment. That is, the gaming system displays five different selectable wagering options 70*a*, 70*b*, 70*c*, 70*d* and 70*e*, which are respectively 60 credits for a game session of 1 minute, 120 credits for a game session of 2 minutes, 180 credits for a game session of 3 minutes, 240 credits for a game session of 4 minutes, and 300 credits for a game session of 5 minutes. The player 72 selects wagering option 70*e* for a game session over a time period of 5 minutes for 300 credits. It should be appreciated that in various embodiments disclosed herein, the gaming system could offer one or more selectable wagering options that are discounted. For example, the gaming system may offer a wagering option of 300 credits for a game session of 6 minutes instead of a wagering option of 300 credits for a game session of 5 minutes. Gaming systems that offer discounted wagering options is further described in U.S. Patent Application Publication No. 2006/0035701 entitled, "METHODS AND APPARATUS FOR FACILITATING A FLAT RATE PLAY SESSION AND FOR EXTENDING SAME."

Figure 5B:
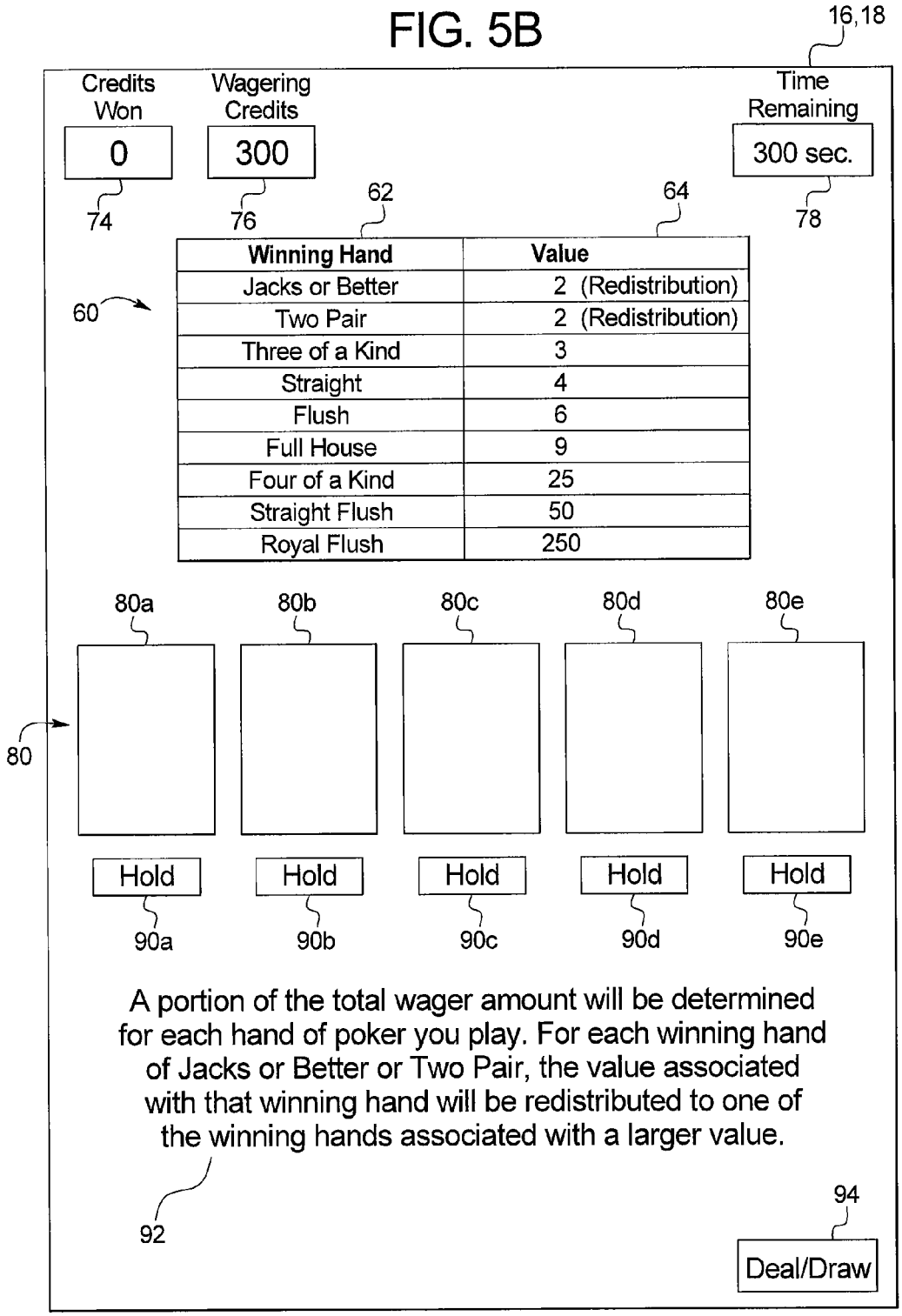

The gaming system then displays a five card draw poker environment with the initial paytable 60 partially displayed in the upper portion of display device 16, 18, as illustrated by FIG. 5B. The initial paytable 60 includes each of the winning outcomes 62 or winning hands (i.e., Jacks or Better, Two Pair, Three of a Kind Straight, Flush, Full House Four of a Kind, Straight Flush, and Royal Flush) associated with the five card draw poker game. The paytable also includes each of the values 64 respectively associated with each of the winning outcomes 62 or winning hands. The gaming system also displays five card areas 80*a*, 80*b*, 80*c*, 80*d* and 80*e*. The card areas 80 are areas in which the cards that are dealt to the player will be displayed for each five card draw poker hand the player plays during the game session. The gaming system also displays player selectable hold buttons 90*a*, 90*b*, 90*c*, 90*d*, and 90*e* respectively associated with each of the card areas 80*a*, 80*b*, 80*c*, 80*d* and 80*e*. The selectable hold buttons 90*a* to 90*e* enable the player to choose which cards to hold for each five card draw poker hand. The gaming system also displays a credits won display 74, a wagering credits display 76 and a time remaining display 78. In this illustrated embodiment, the player placed a wager of 300 credits for a time period of 5 minutes (i.e., 300 seconds). The wagering credits display 76 accordingly shows 300 total credits and the time remaining display accordingly shows 300 seconds. The credits won display displays 0 because the player has not won any credits yet. The gaming system also displays a selectable Deal/Draw button 94 in the lower right hand corner of the display device 16, 18. The Deal/Draw 94 button enables the player to control when the cards are dealt to the player for each five card draw poker hand and which cards to hold for each five card draw poker hand. The gaming system also displays a message 92 of, "A PORTION OF THE TOTAL WAGER AMOUNT WILL BE DETERMINED FOR EACH HAND OF POKER YOU PLAY. FOR EACH WINNING HAND OF JACKS OR BETTER OR TWO PAIR, THE VALUE ASSOCIATED WITH THAT WINNING HAND WILL BE REDISTRIBUTED TO ONE OF THE WINNING HANDS ASSOCIATED WITH A LARGER VALUE."

Figure 5C:
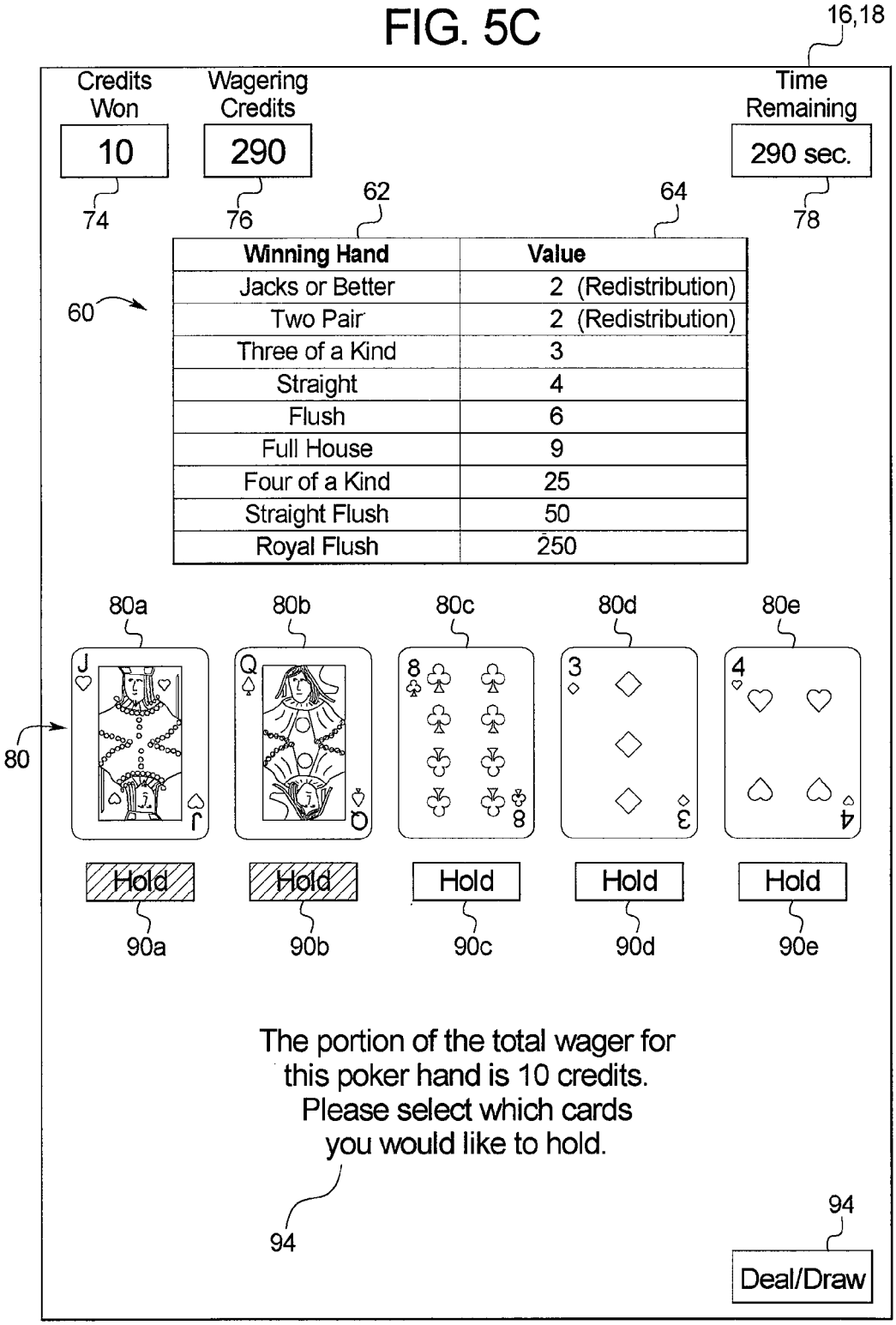

Turning now to FIG. 5C, when the player hits the Deal/Draw button 94, the gaming system determines a portion of the total wager amount for the first dealt poker hand based at least in part on the amount of time that has transpired since the beginning of the game session. Before the cards are dealt to the player for this first hand, ten seconds elapsed since the beginning of the game session, as indicated by the time remaining display showing 290 seconds. Thus, the gaming system determined that the portion of the total wager associated with this wagering event (i.e., this hand of the poker game session) is 10 credits. The gaming system displays five cards that were dealt to the player in a first five card draw poker hand of the game session, as illustrated by FIG. 5C. The gaming system dealt a Jack of Hearts, a Queen of Spades, an Eight of Clubs, a Three of Diamonds, and a Four of Hearts, which are displayed in card areas 80*a*, 80*b*, 80*c*, 80*d* and 80*e* respectively. The gaming system displays a message 94 of "THE PORTION OF THE TOTAL WAGER FOR THIS POKER HAND IS 10 CREDITS. PLEASE SELECT WHICH CARDS YOU WOULD LIKE TO HOLD." The player decided to hold the Jack of Hearts and the Queen of Spades, as illustrated by selectable hold buttons 90*a* and 90*b* being highlighted in FIG. 5C.

Figure 5D:
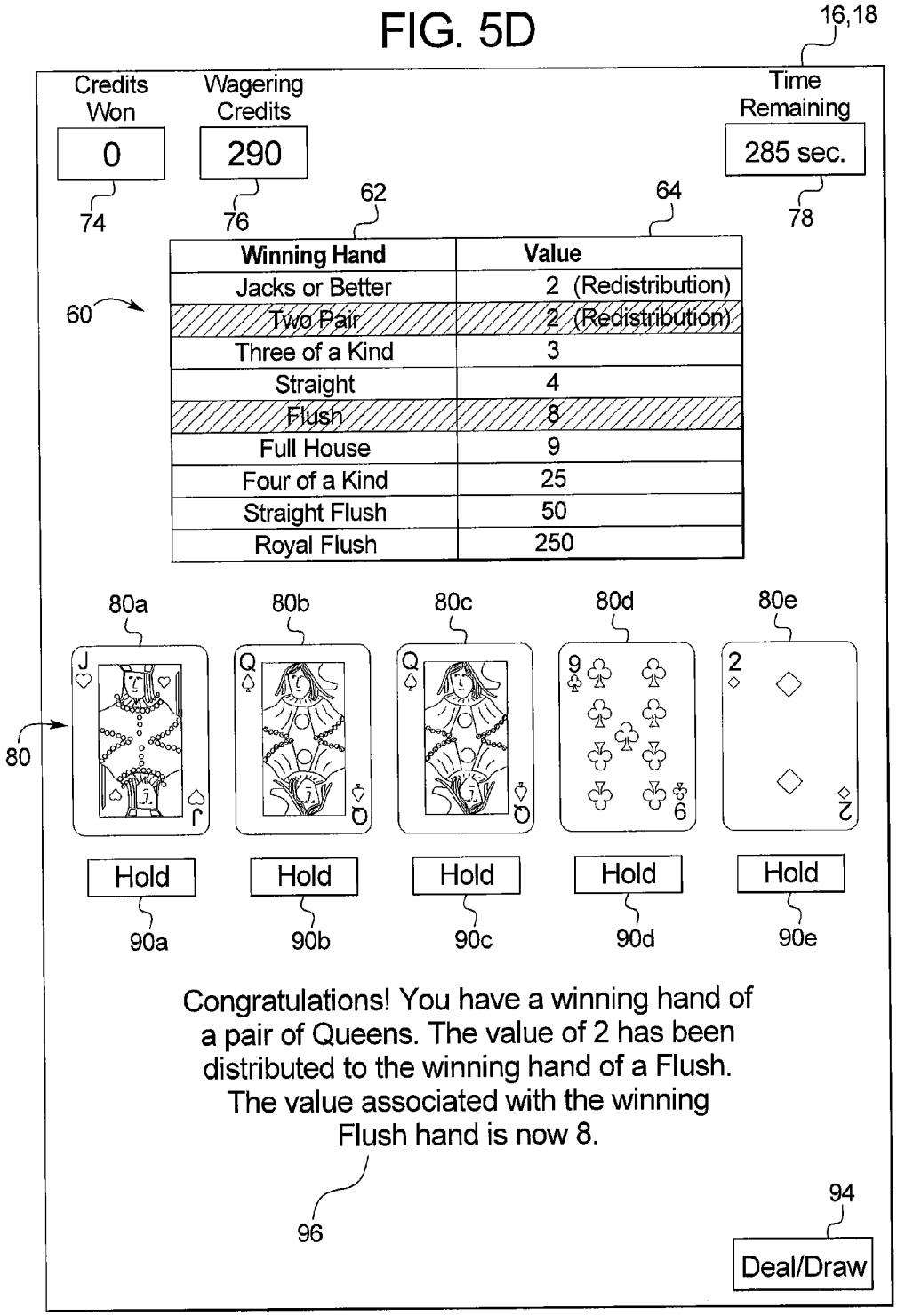

The gaming system displays three new cards that were dealt to the player, which form a winning hand with the two cards the player held, as illustrated by FIG. 5D. The gaming system dealt a Queen of Spades, a Nine of Clubs and a Two of Diamonds, as shown in card areas 90*c*, 90*d* and 90*e*, respectively. The held card of Queen of Hearts and the dealt card of Queen of Spades form a winning hand of Two Pair. Two Pair is a winning outcome associated with a value of 2, which is a redistribution value. The gaming system accordingly causes the value of 2 to be redistributed (i.e., added) to the value associated with the winning hand of Flush and illustrates that this redistribution has occurred by highlighting the Two Pair and the Flush in paytable 60. The winning hand of Flush is now associated with a value of 8. Thus, the winning outcome of Flush (unless further subsequently increased) is associated with a value of 8 for all subsequent poker hands dealt during the game session (i.e., for each subsequent wagering event). The winning hand of Two Pair remains associated with the redistribution value of 2 for all subsequent wagering events. The gaming system displays message 96 of, "CONGRATULATIONS YOU HAVE A WINNING HAND OF A PAIR OF QUEENS. THE VALUE OF 2 HAS BEEN REDISTRIBUTED TO THE WINNING HAND OF A FLUSH. THE VALUE ASSOCIATED WITH THE WINNING FLUSH HAND NOW HAS A VALUE OF 8." In this example, the gaming system does not provide the player with any credits for the winning hand of Two Pair, as indicated by the credits won display showing 0 credits. It should be appreciated that the in other embodiments, the gaming system provides the player with an award based at least in part on the value of 2.

Figure 5E:
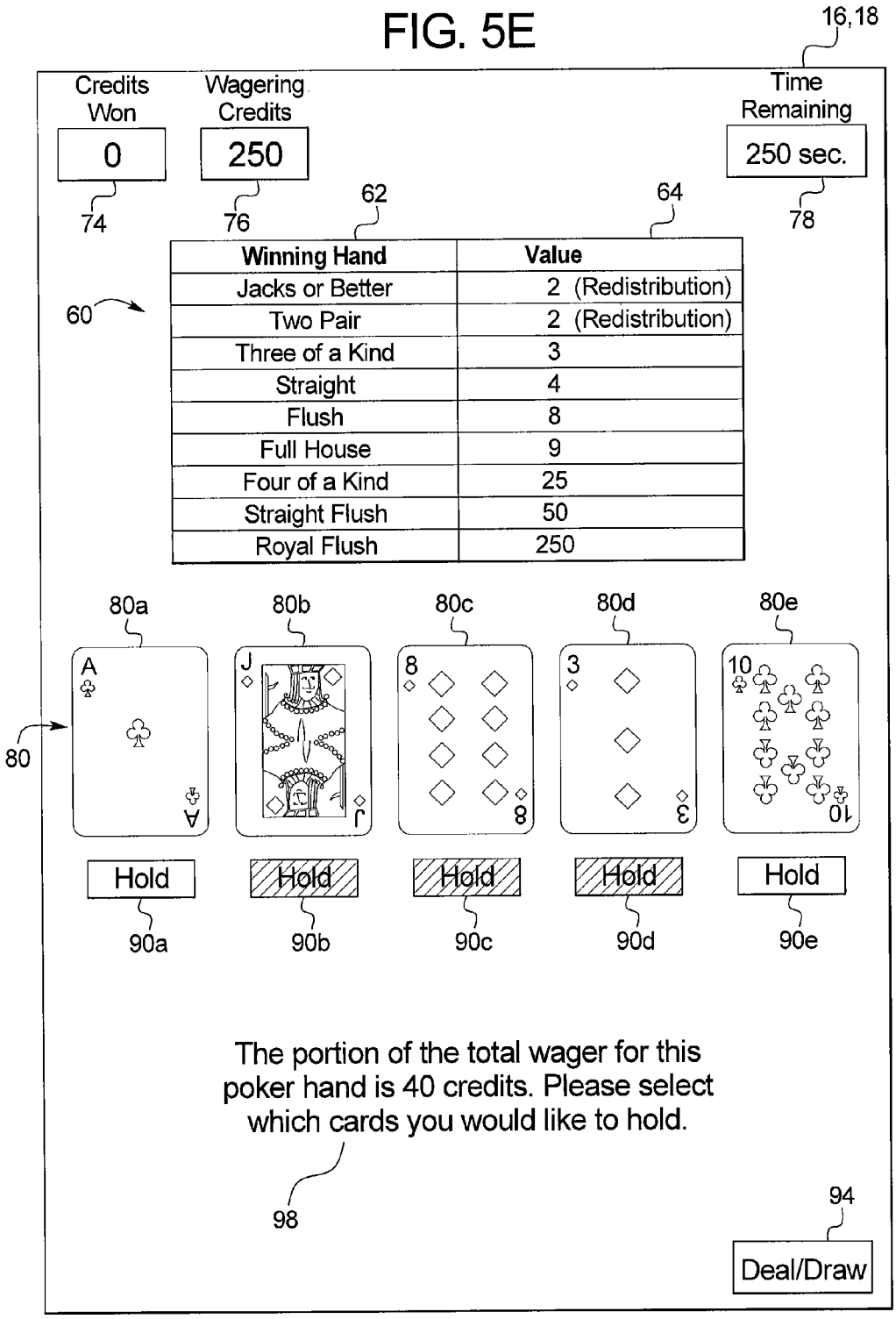

Turning now to FIG. 5E, when the player hits the Deal/Draw button 94 for a second hand, the gaming system determines a portion of the total wager amount for the second poker hand based at least in part on the amount of time that has transpired since the player hit the Deal/Draw button 94 for the first hand (i.e., the previous wagering event). Before the cards are dealt to the player for the second hand, forty seconds elapsed since the previous wagering event, as indicated by the time remaining display showing 250 seconds. Thus, the gaming system determined that the portion of the total wager associated with this wagering event (i.e., this hand of the poker game session) is 40 credits. The gaming system displays five new cards that were dealt for a second five card draw poker hand of the game session, as illustrated by FIG. 5E. The gaming system dealt an Ace of Clubs, a Jack of Diamonds, an Eight of Diamonds, a Three of Diamonds, and a Ten of Clubs, which are displayed in card areas 80*a*, 80*b*, 80*c*, 80*d* and 80*e* respectively. The gaming displays message 98 to the player of, "THE PORTION OF THE TOTAL WAGER FOR THIS POKER HAND IS 40 CREDITS. PLEASE SELECT WHICH CARDS YOU WOULD LIKE TO HOLD." The player decided to hold the Jack of Diamonds and the Eight of Diamonds, as illustrated by selectable hold buttons 90*b* and 90*c* being highlighted.

Figure 5F:
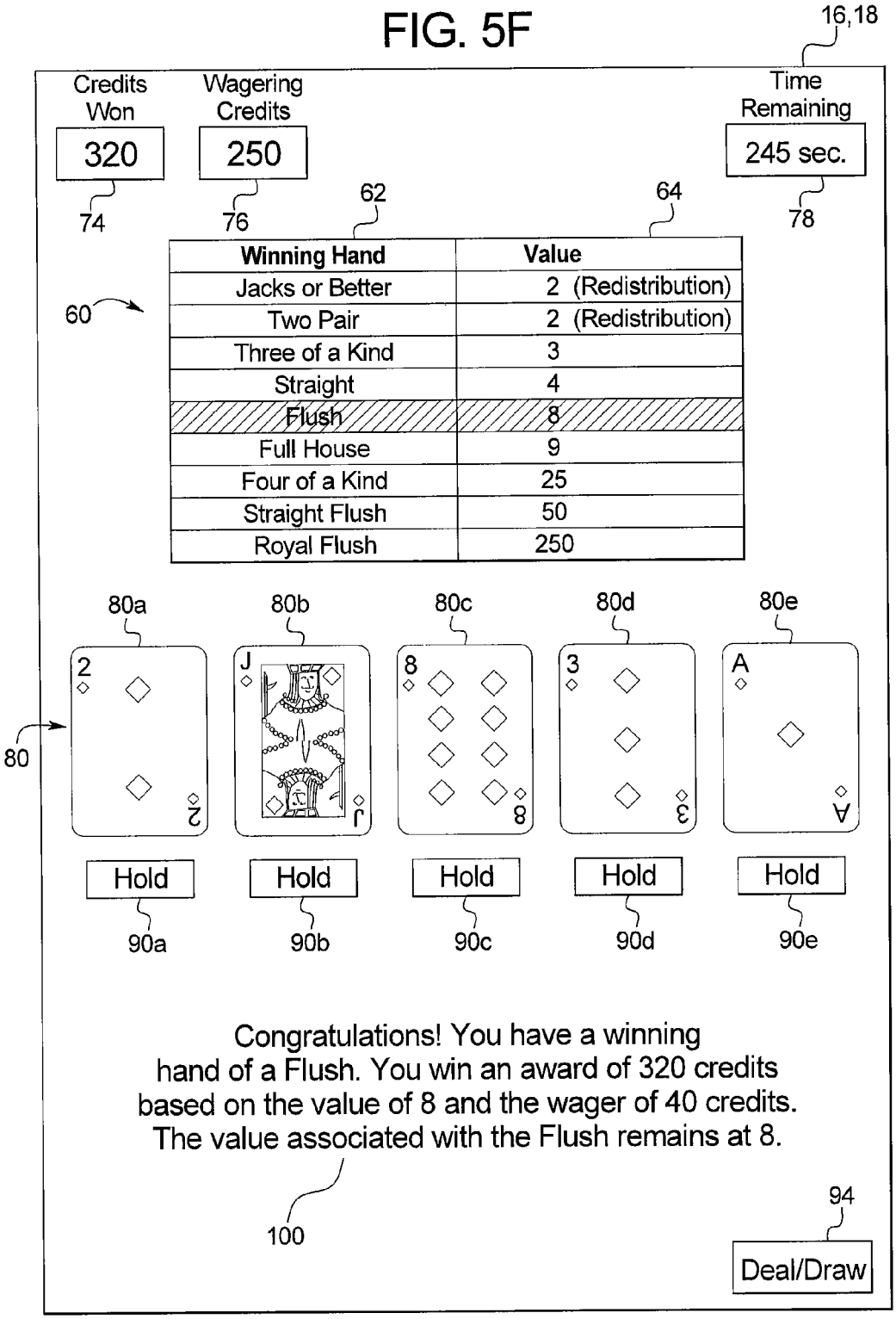

The gaming system displays three new cards that were dealt to the player, which form a winning hand with the two cards the player held, as illustrated by FIG. 5F. The player was dealt a Two of Diamonds, a Three of Diamonds, and an Ace of Spades, as shown in card areas 90*a*, 90*d* and 90*e* respectively. The held cards of Jack of Diamonds and Eight of Diamonds with the dealt cards of Two of Diamonds, Three of Diamonds, and Ace of Diamonds form a winning hand of a Flush. Flush is a winning outcome associated with a value of 8 that is a payout value. The gaming system accordingly determines an award of 320 credits based at least in part on the value of 8 and the wager of 40 credits and provides the 320 credits to the player. The gaming system displays the value of 320 credits in the credits won display 74. The winning hand of Flush remains associated with the value of 8. Thus, the winning outcome of Flush is (unless further subsequently increased) associated with a value of 8 for all subsequent poker hands dealt during the game session (i.e., for each subsequent wagering event). The gaming system displays message 100 of, "CONGRATULATIONS! YOU HAVE A WINNING HAND OF A FLUSH. YOU WIN AN AWARD OF 320 CREDITS BASED ON THE VALUE OF 8 AND THE WAGER OF 40 CREDITS. THE VALUE ASSOCIATED WITH THE FLUSH REMAINS AT 8."

Figure 5G:
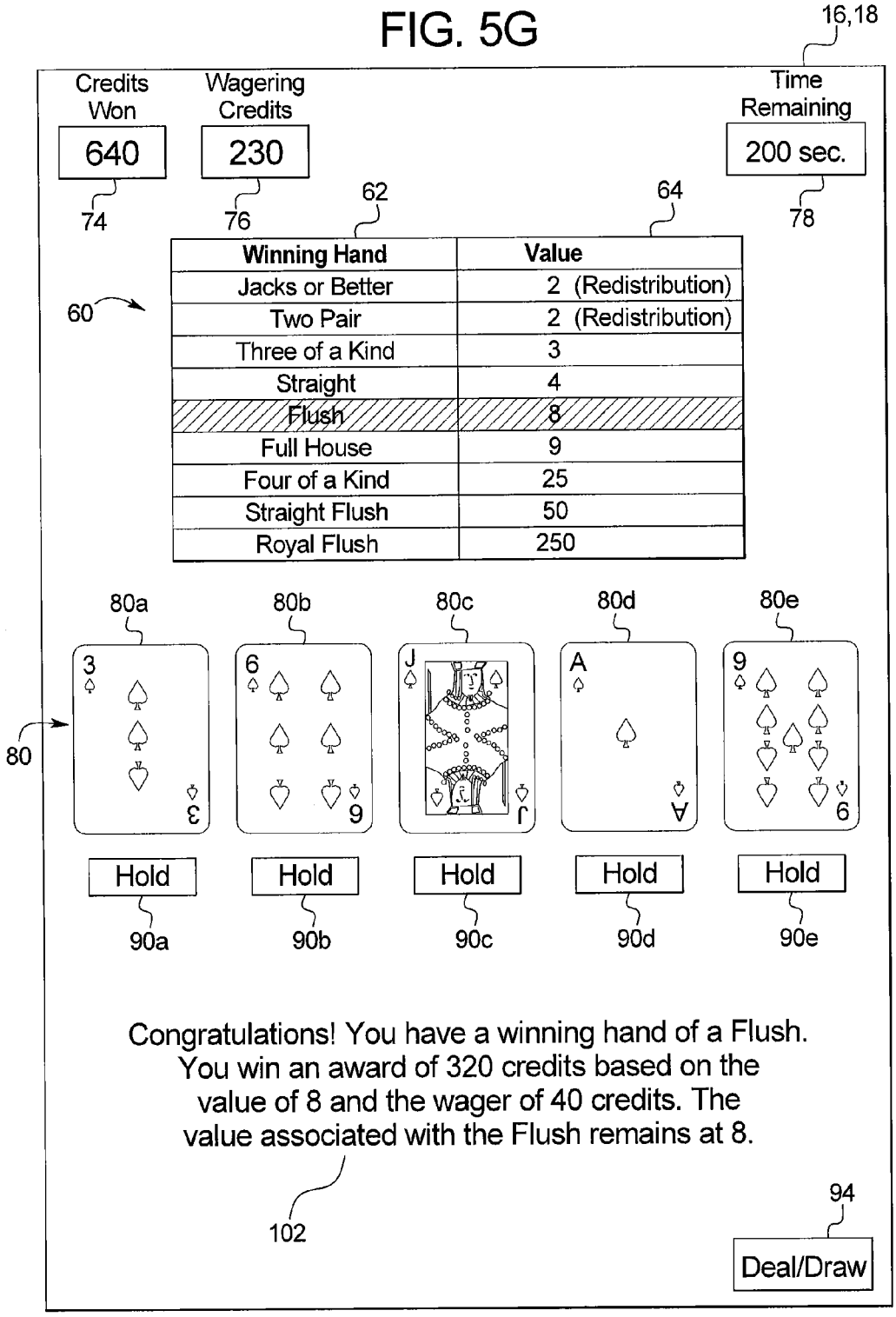

For a subsequent wagering event during the game session in which the determined portion of the total wager is again 40 credits, the gaming system displays the result of another hand of five card draw poker, as illustrated by FIG. 5G. In this hand of poker, the player obtained another winning hand of Flush. That is, the gaming system displays a Three of Spades, a Six of Spades, a Jack of Spades, an Ace of Spades and a Nine of Spades in card areas 90*a*, 90*b*, 90*c*, 90*d* and 90*e* respectively. These cards form another winning hand of a Flush. The gaming system accordingly determines an award of 320 credits based at least in part on the value of 8 and the determined portion of the total wager of 40 credits and provides the 320 credits to the player. The gaming system adds the 320 credits to the previous number of credits won and displays the total credits won of 640 credits (320 previous credits won plus the additional 320 credits) in the credits won display 74. The gaming system displays message 102 of, "CONGRATULATIONS. YOU HAVE A WINNING HAND OF A FLUSH. YOU WIN AN AWARD OF 320 CREDITS BASED ON THE VALUE OF 8 AND THE WAGER OF 40 CREDITS. THE VALUE ASSOCIATED WITH THE FLUSH REMAINS AT 8." It should be appreciated that the total number of credits the player won of 640 is greater than the number of credits the player would have won if the player achieved the same winning outcomes of Two Pair, Flush and Flush, without the redistribution of the present disclosure, and specifically without adding (i.e., redistributing) the redistribution value of 2 associated with the Two Pair to the initial Flush value of 6 to form a new value of 8 associated with the Flush hand. That is, if the gaming system did not add the value of 2 associated with the Two Pair to the initial Flush value of 6 to create a new value of 8 associated with the Flush hand, the gaming system would have provided a total number of credits of 500 to the player (20 credits for the Two Pair, 240 credits for the first Flush hand and 240 credits for the second Flush hand).

Figure 5H:
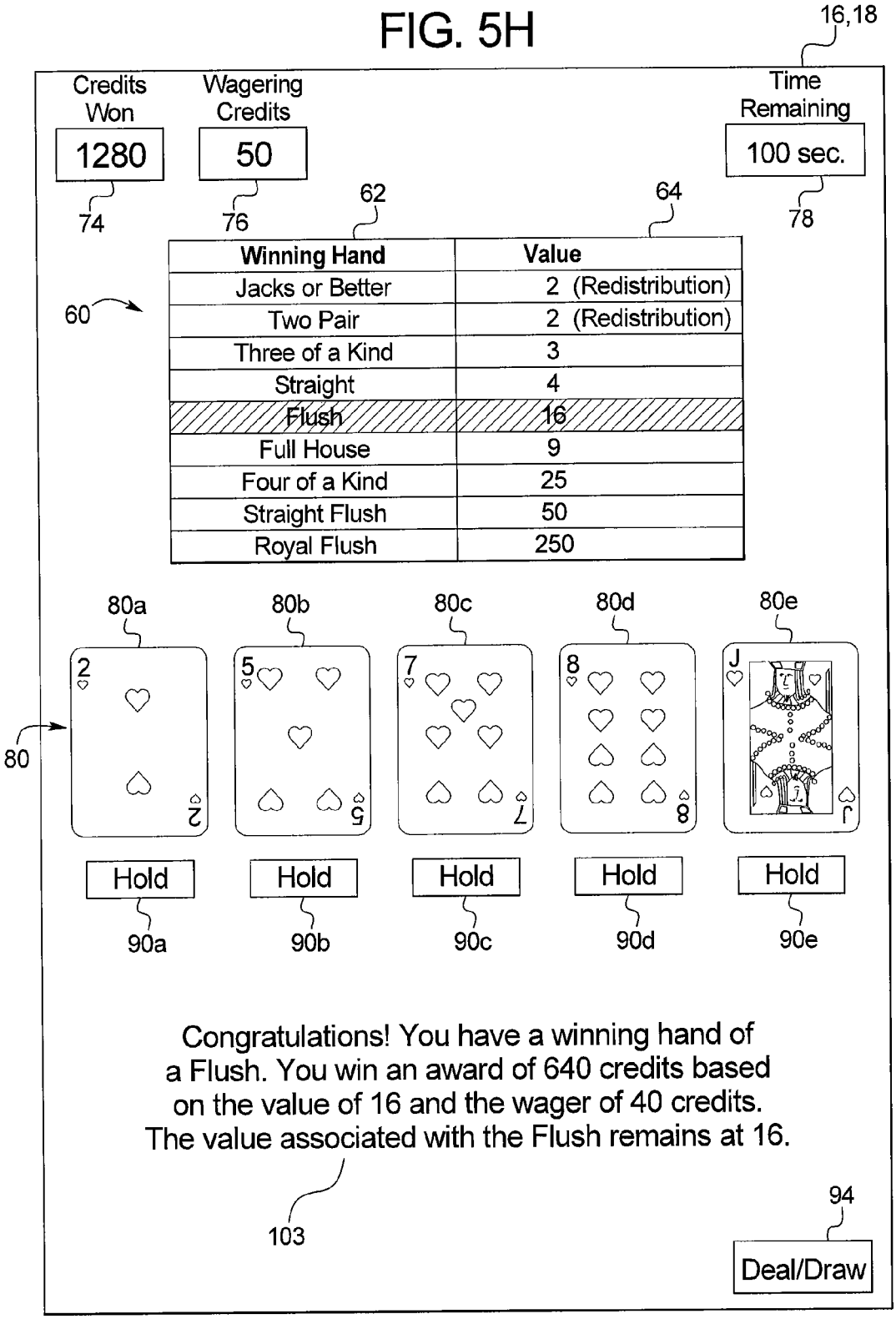

FIG. 5H shows the result of another hand of five card draw poker after the gaming system dealt the player four previous hands (i.e., four previous wagering events) of Two Pairs. For each of these four previous wagering events in which the player was dealt a winning hand of Two Pair, the gaming system caused the value associated with the Flush winning outcome to increase by the value of 2 associated with the Two Pair winning outcome, resulting in a value of 16 (i.e., 2 times 4, plus the previous value of 8) associated with the winning outcome of Flush. For the illustrated wagering event in FIG. 5H, the gaming system displays the winning Flush hand of Two of Hearts, Five of Hearts, Seven of Hearts, Eight of Hearts, and Jack of Hearts in card areas 90*a*, 90*b*, 90*c*, 90*d* and 90*e* respectively. For the illustrated wagering event in FIG. 5H, the determined portion of the total wager was again 40 credits. The gaming system accordingly determines an award of 640 credits based at least in part on the value of 16 and the determined portion of the total wager of 40 credits and provides the 640 credits to the player. The gaming system adds the 640 credits to the previous number of credits won and displays the total credits won of 1280 (640 previous credits won plus the additional 640 credits) in the credits won display 74. The gaming system displays message 103 of, "CONGRATULATIONS! YOU HAVE A WINNING HAND OF A FLUSH. YOU WIN AN AWARD OF 640 CREDITS BASED ON THE VALUE OF 16 AND THE WAGER OF 40 CREDITS." It should be appreciated that the total number of credits the player won of 1280 is greater than the total number of credits the player would have won if the player achieved the same winning outcomes of Two Pair, Flush, Flush, Two Pair, Two Pair, Two Pair, Two Pair, Flush, without the redistribution of the present disclosure, and specifically without adding (i.e., redistributing) the redistribution value of 2 associated with the Two Pair added to the value associated with the Flush hand multiple times to form a new value of 16 associated with the Flush hand.

In another example embodiment, a time based game session includes plurality of wagering events and one of the winning outcomes is associated with a designated change outcome that changes or increases a time value and increases a number of wagering credits and another one of the winning outcomes is associated with a designated change outcome that changes or increases a wager value, as illustrated by FIGS. 6A to 6F. In this example embodiment, a player places a total wager for an outer space shooting game session. In the outer space shooting game session, the gaming system enables a player to shoot at various objects such as aliens, small and large asteroids. A wagering event occurs each time a player shoots at one of the objects in the outer space shooting game.

Figure 6A:
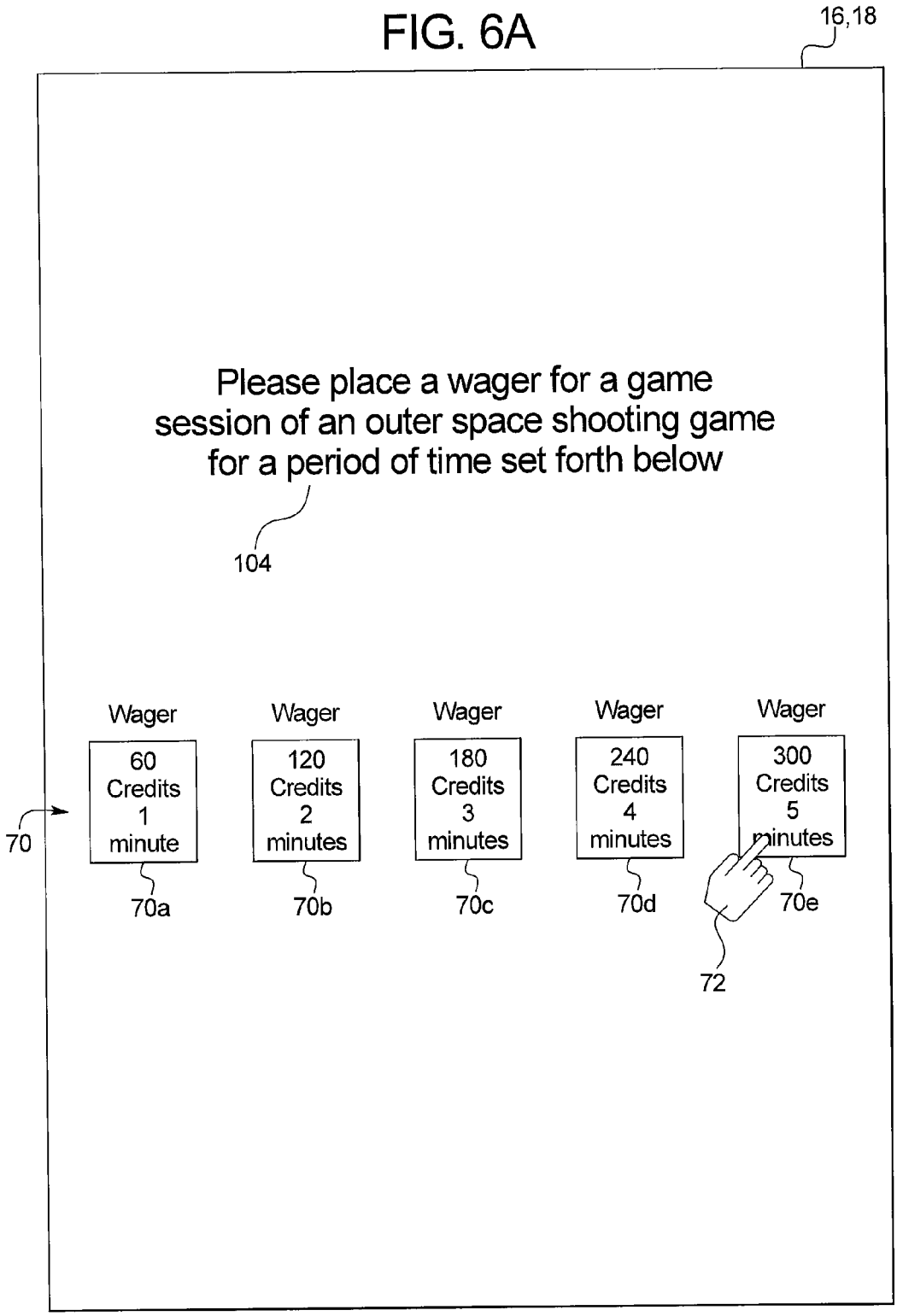
FIGS. 6A, 6B, 6C, 6D, 6E and 6F are front views of a gaming device display providing a play of a game in accordance with an example of another embodiment of the gaming system disclosed herein.

Referring now more specifically to FIGS. 6A to 6F, the gaming system enables the player place a wager for designated period of time, as illustrated by FIG. 6A. The gaming system displays on display device 16, 18 message 104 of, "PLEASE PLACE A WAGER TO PLAY A GAME SESSION OF AN OUTER SPACE SHOOTING GAME FOR A PERIOD OF TIME SET FORTH BELOW." The gaming system also displays selectable wagering options 70*a*, 70*b*, 70*c*, 70*d* and 70*e*. The gaming system enables the player to select one of the selectable wagering options 70. Each selectable wagering option 70 corresponds to a designated period of time for the game session. Similar to the example embodiment described above, the longer the period of time the player wishes the game session to occur, the greater number of credits the gaming system requires the player to wager. That is, the gaming system displays the five different selectable wagering options 70*a*, 70*b*, 70*c*, 70*d* and 70*e* of 60 credits for a game session of 1 minute, 120 credits for a game session of 2 minutes, 180 credits for a game session of 3 minutes, 240 credits for a game session of 4 minutes and 300 credits for a game session of 5 minutes respectively. The player 72 selects a game session for a time period of 5 minutes for 300 credits in this example.

Figure 6B:
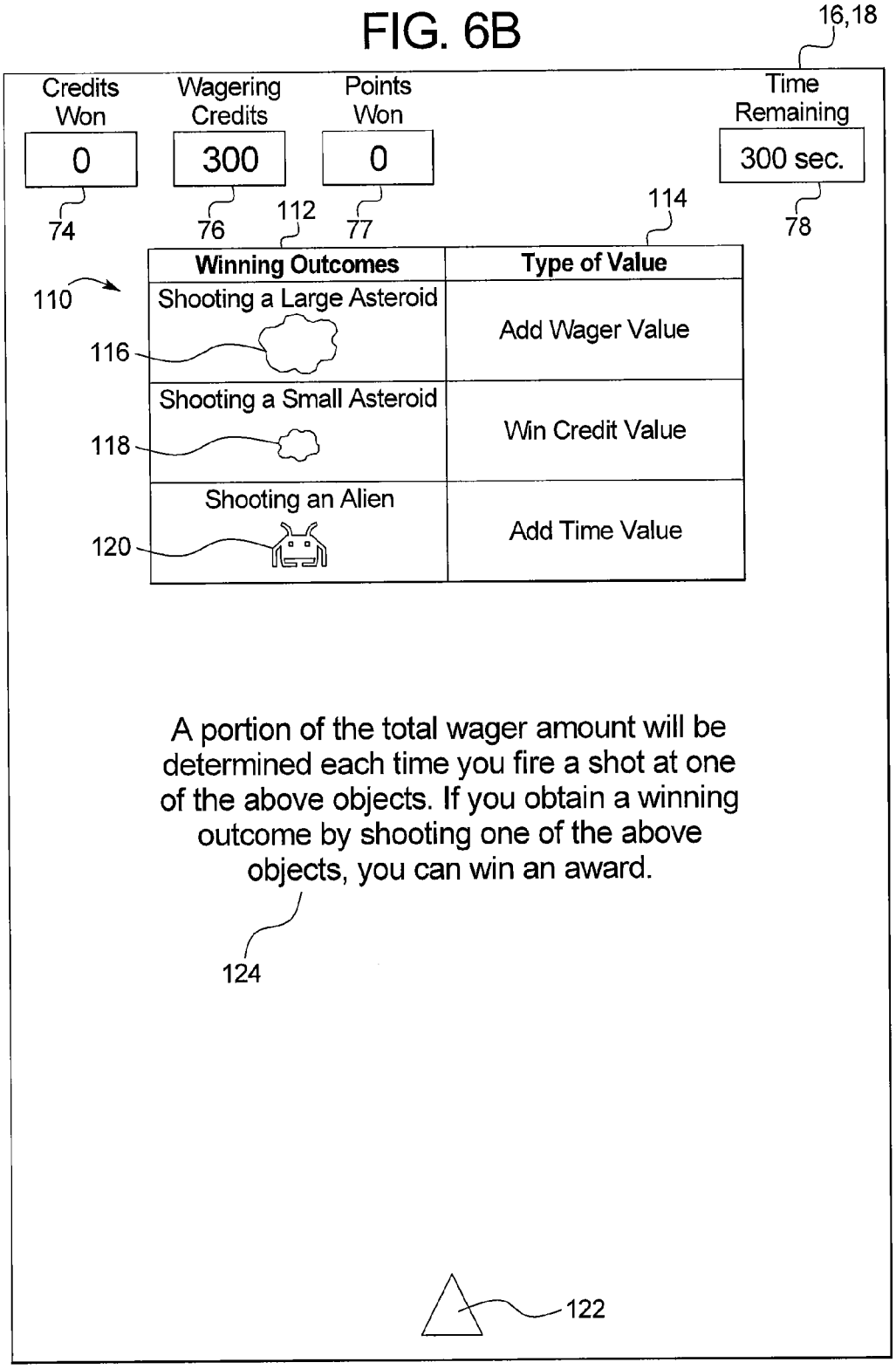

The gaming system displays paytable 110 in the upper portion of display device 16, 18, as illustrated by FIG. 6B. The paytable 110 includes each of the winning outcomes 112 (i.e., shooting a large asteroid 116, shooting a small asteroid 118, and shooting an alien 120) associated with wagering events that occur in the outer space shooting game. The paytable 110 also includes each type of value 114 associated with each of the winning outcomes 112. The type of value associated with shooting the large asteroid is an add wager value (i.e., a subsequent bet increase value). The type of value associated with shooting a small asteroid is a win credit value. The type of value associated with shooting an alien is an add time value (i.e., time increase value). In this embodiment, the paytable is initially displayed to the player at the beginning of the game session, but is not displayed in the remainder of the game session. It should be appreciated that in various other embodiments, the paytable 110 could be continuously displayed throughout the outer space shooting game session or displayed at any suitable time during the game session. The gaming system also displays a player controlled spaceship 122 in the lower portion of the display device 16, 18, a credits won display 74, a wagering credits display 76, a points won display 77, and a time remaining display 78. The player placed a wager of 300 credits for a time period of 5 minutes (i.e., 300 seconds). The wagering credits display 76 accordingly shows 300 total credits and the time remaining display 78 accordingly shows 300 seconds. The credits won display 74 and the points won display 77 each display 0 because the player has not won any credits or points yet. The gaming system also displays a message 124 of, "A PORTION OF THE TOTAL WAGER AMOUNT WILL BE DETERMINED EACH TIME YOU FIRE A SHOT AT ONE OF THE ABOVE OBJECTS. IF YOU OBTAIN A WINNING OUTCOME BY SHOOTING ONE OF THE ABOVE OBJECTS, YOU CAN WIN AN AWARD." It should be appreciated that in the embodiment illustrated by FIGS. 6A to 6F, if a player shoots at and destroys one of the objects such as the alien, small asteroid or large asteroid, the gaming system does not automatically provide an award to the player. Instead, if a player shoots at and destroys one of the plurality of objects, the gaming system randomly determines whether to provide an award. Any randomly determined award is based on the type of value associated with the respective object that the player shot at and destroyed, as described in more detail below.

Figure 6C:
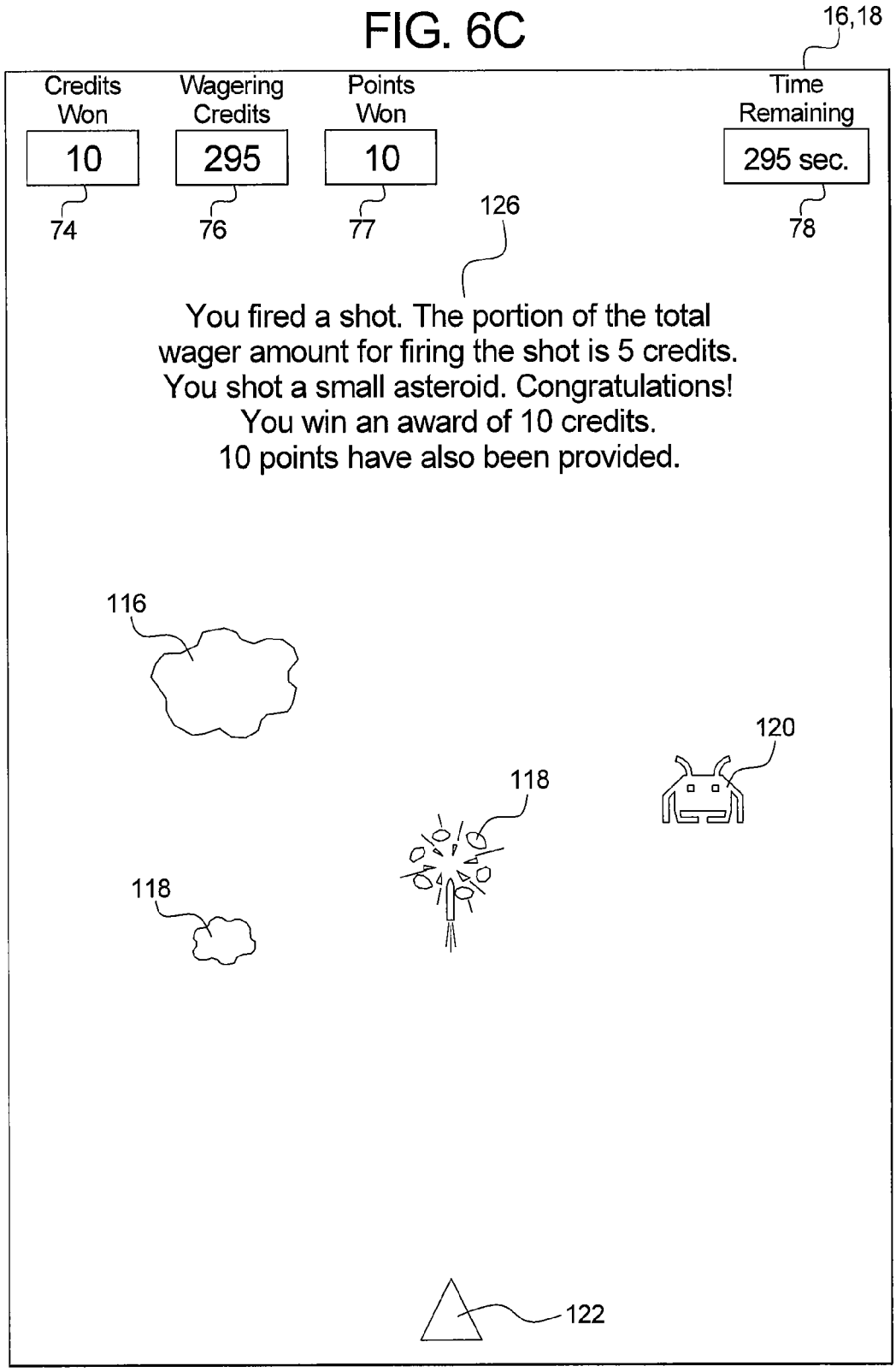

The gaming system displays the result of the player having shot a small asteroid 118 in the outer space shooting game (i.e., a first wagering event), as illustrated by FIG. 6C. The gaming system determines a portion of the total wager amount at the point in time when the player fired the shot based at least in part on the amount of time that has transpired since the beginning of the game session. When the player fired the shot, five seconds had elapsed since the beginning of the game session, as indicated by the time remaining display showing 295 seconds. Thus, the gaming system determined that the portion of the total wager associated with this wagering event (i.e., shooting at the large asteroid) is 5 credits. The gaming system subtracted 5 credits from 300 for a total number of wagering credits of 295 as shown in the wagering credits display 76. The player shot the small asteroid 118 as shown by the exploding asteroid 118. Shooting the small asteroid 118 is a winning outcome associated with an increase credit value. The gaming system references a paytable associated with the increased credit value and randomly determined that an award of 10 credits is associated with shooting the small asteroid 118 and the wager of 5 credits. Thus, the gaming system provides the player with an award of 10 credits and displays the 10 credits in the credits won display 74. The gaming system also provides the player with 10 points for shooting the small asteroid 118 and displays the 10 points in the points won display 77. The gaming system displays message 126 of, "YOU FIRED A SHOT. THE PORTION OF THE TOTAL WAGER AMOUNT FOR FIRING THE SHOT IS 5 CREDITS. YOU SHOT A SMALL ASTEROID. CONGRATULATIONS! YOU WIN AN AWARD OF 10 CREDITS. 10 POINTS HAVE ALSO BEEN PROVIDED."

Figure 6D:
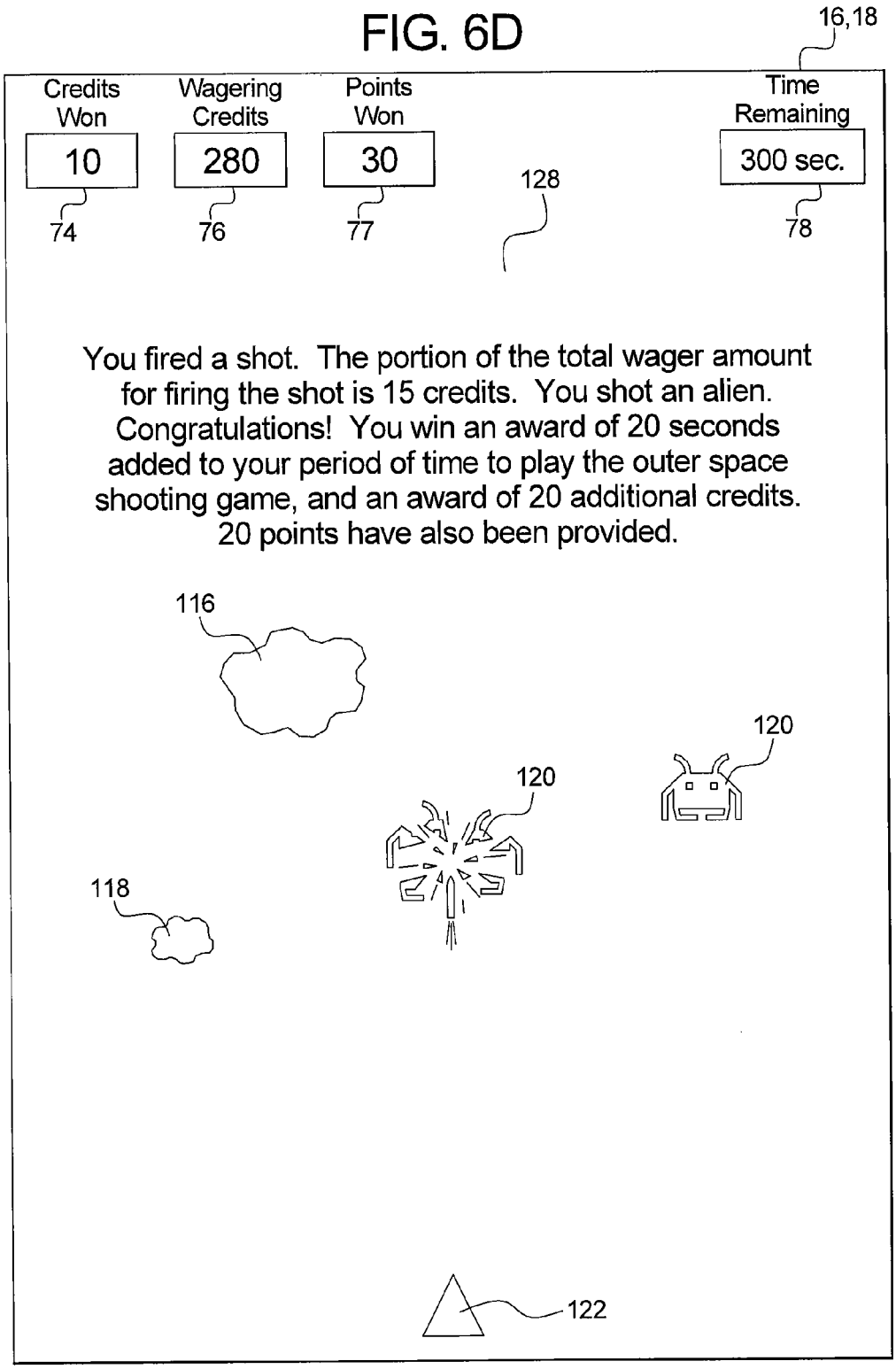

The gaming system displays the result of the player having shot an alien 120 in the outer space shooting game (i.e., a second wagering event), as illustrated by FIG. 6D. The gaming system determines a portion of the total wager amount at the point in time when the player fired the shot based at least in part on the amount of time that has transpired since the previous shot was fired. The previous shot that was fired was the shot that hit the small asteroid 118 (i.e., the first wagering event). When the player fired the shot at the alien 120, fifteen seconds had elapsed since the previous shot that was fired at the small asteroid 118. Thus, the gaming system determined a portion of the total wager amount for firing the shot at the alien 120 is fifteen credits. The gaming system subtracted the fifteen credits from 295 for a total number of wagering credits of 280, as shown in the wagering credits display 76. The player shot the alien 120 as shown by the exploding alien 120. Shooting the alien 120 is a winning outcome associated with an add time increase value (i.e., a time increase value). The gaming system randomly determined that a time increase value of 20 seconds will be added to the time remaining for the game session. Twenty total seconds had elapsed since the beginning of the game session for a time remaining of 280 seconds. Thus, the gaming system added the 20 additional seconds from the time increase value to the 280 seconds for a time remaining of 300 seconds, as shown in the time remaining display 78. The gaming system also provides the player with 20 points for shooting the alien 120 and displays 30 total number of points won (20 points plus the previous 10 points) in the points won display 77. In addition to providing more time to play the game session, if the displayed outcome is a winning outcome associated with the time increase value, the gaming system also randomly determines a number of additional credits to provide the player for the game session. This benefits the player because it provides one or more additional wagering events that can occur and thus could provide the player with awards for each of those additional wagering events. The gaming system displays message 128 of, "YOU FIRED A SHOT. THE PORTION OF THE TOTAL WAGER AMOUNT FOR FIRING THE SHOT IS 15 CREDITS. CONGRATULATIONS YOU WIN AN AWARD OF 20 SECONDS ADDED TO YOUR PERIOD OF TIME TO PLAY THE OUTER SPACE SHOOTING GAME AND AN AWARD OF 20 ADDITIONAL CREDITS. 20 POINTS HAVE ALSO BEEN PROVIDED." It should be appreciated that in various embodiments, instead of the gaming system providing 20 additional credits for the 20 seconds added to the period of time to play the game session, the gaming system provides more than 20 additional credits for the 20 seconds added. In one such example, the gaming system provides 40 additional credits for the 20 seconds that are added to the period of time to play the game session.

Figure 6E:
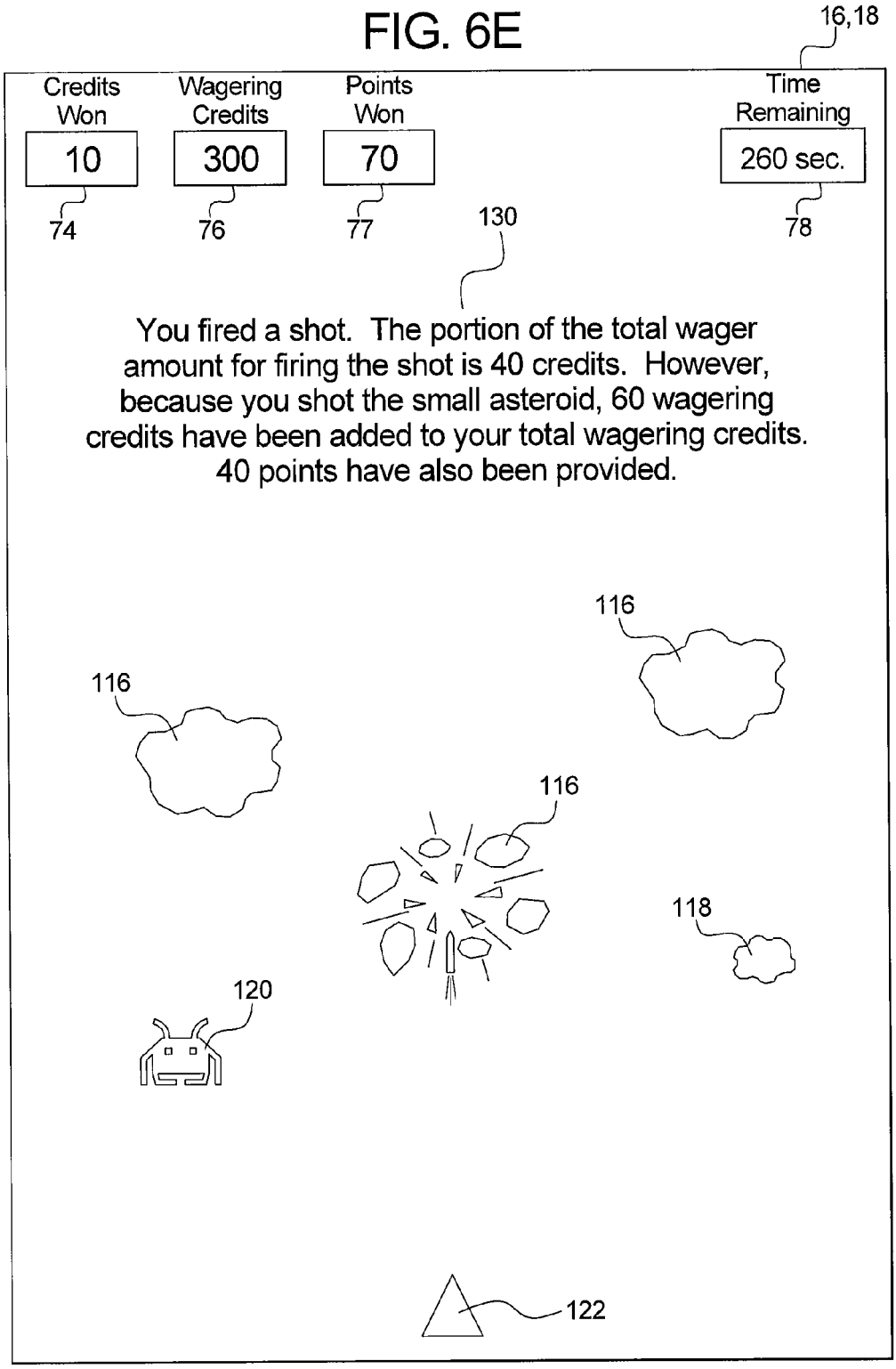

The gaming system displays the result of the player having shot a large asteroid 116 in the outer space shooting game (i.e., a third wagering event), as illustrated by FIG. 6E. The gaming system determines a portion of the total wager amount at the point in time when the player fired the shot based at least in part on the amount of time that has transpired since the previous shot that was fired. The previous shot that was fired was the shot that hit the alien 120 (i.e., the second wagering event). When the player fired the shot at the large asteroid 118, forty seconds elapsed since the previous shot that was fired that hit the alien 120. Thus, the gaming system determined a portion of the total wager amount for firing the shot at the large asteroid 116 is forty credits. However, the player shot the large asteroid 116 as shown by the exploding large asteroid 116. Shooting the large asteroid 116 is a winning outcome associated with an add wager value (i.e., a subsequent bet increase value). The gaming system randomly determined that a bet increase value of 60 wagering credits will be added to the total number of wagering credits to be wagered for subsequent wagering events. Thus, the gaming system added 60 wagering credits to the total wagering credits for a total number of wagering credits to be wagered for subsequent wagering events of 300, as shown in the wagering credits display 78. The gaming system also provides the player with 40 points for shooting the large asteroid 116 and displays 70 total number of points won (40 points plus the previous 30 points) in the points won display 77. The gaming system displays message 130 of, "YOU FIRED A SHOT. THE PORTION OF THE TOTAL WAGER AMOUNT FOR FIRING THE SHOT IS 40 CREDITS. HOWEVER, BECAUSE YOU SHOT THE SMALL ASTEROID, 60 WAGERING CREDITS HAVE BEEN ADDED TO YOUR TOTAL WAGERING CREDITS. 40 POINTS HAVE ALSO BEEN PROVIDED." It should be appreciated that this third wagering event causes the total number of wagering credits to increase, which causes the portion of the total wager amount to increase for at least one subsequent wagering event. Thus, if the displayed outcome for that subsequent wagering event is associated with a win credit value, the gaming system may randomly determine a larger credit value to provide the player for that subsequent wagering event.

Figure 6F:
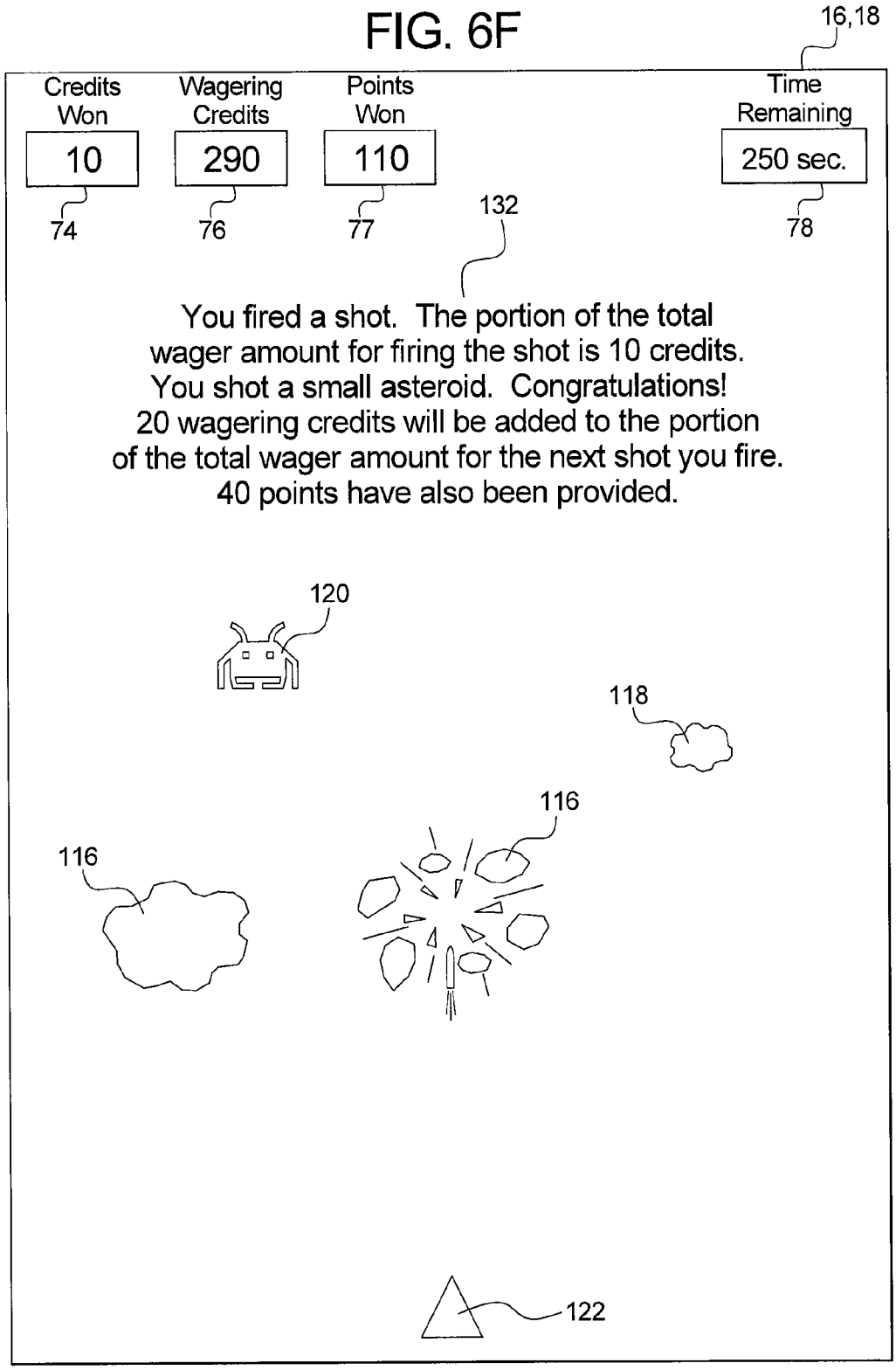

The gaming system displays the result of the player having shot another large asteroid 116 in the outer space shooting game (i.e., a fourth wagering event), as illustrated by FIG. 6F. The gaming system determines a portion of the total wager amount at the point in time when the player fired the shot based at least in part on the amount of time that has transpired since the previous shot that was fired. The previous shot that was fired was the shot that hit the large asteroid 116 (i.e., the third wagering event). When the player fired the shot at the large asteroid 116 for the second time, ten seconds elapsed since the previous shot that was fired that hit the large asteroid 116. Thus, the gaming system determined a portion of the total wager amount for firing the shot at the large asteroid 116 is 10 credits. The gaming system subtracted the ten credits from 300 for a total number of wagering credits of 290, as shown in the wagering credits display 72. The player shot the large asteroid 116 as shown by the exploding large asteroid 118. Shooting the large asteroid 116 is a winning outcome associated with an add wager value (i.e., a subsequent bet increase value). The gaming system randomly determined that a bet increase value of 20 wagering credits will be added to the determined portion of the total wager amount for the next wagering event. The gaming system also provides the player with 40 points for shooting the large asteroid 118 and displays 110 total number of points won (40 points plus the previous 70 points) in the points won display 77. The gaming system displays message 132 of, "YOU FIRED A SHOT. THE PORTION OF THE TOTAL WAGER AMOUNT FOR FIRING THE SHOT IS 10 CREDITS. YOU SHOT A SMALL ASTEROID. CONGRATULATIONS! 20 WAGERING CREDITS WILL BE ADDED TO THE PORTION OF THE TOTAL WAGER AMOUNT FOR THE NEXT SHOT YOU FIRE. 40 POINTS HAVE ALSO BEEN PROVIDED." It should be appreciated that unlike the third wagering event, in which the bet increase value was added to the total number of wagering credits, for this fourth wagering event, the gaming system will add 20 wagering credits to the determined portion of the total wager amount for the next wagering event. Thus, the bet increase value for this wagering event causes the portion of the total wager for a subsequent wagering event to automatically increase by 20 credits. Thus, it should be appreciated that, because the wager amount is increased for the subsequent wagering event, if the displayed outcome for that subsequent wagering event is associated with a win credit value, the gaming system may determine a larger credit award value to provide the player for that subsequent wagering event. It should be appreciated that instead of the gaming system increasing the portion of the total wager amount by 20 credits for the next wagering event, the gaming system could increase the portion of the total wager amount for any subsequent wagering event.

It should be appreciated that in various embodiments including a plurality of winning outcomes in which each of the winning outcomes is associated with one of a payout value and a redistribution value, the gaming system can associate any suitable number of winning outcomes with a payout value, and associate any suitable number of winning outcomes with a redistribution value. In one example of a five card draw poker game session embodiment, instead of associating two winning outcomes (i.e., Jacks or Better and Two Pair) with a redistribution value, the gaming system associates three or more winning outcomes (e.g., Jacks or Better, Two Pair and Three of a Kind) with a redistribution value. In this example, the gaming system associates each of the remaining winning outcomes with a payout value.

In various other embodiments in which each of the winning outcomes is associated with one of a payout value and a redistribution value, instead the gaming system linking each redistribution value with a plurality of payout values (i.e., each redistribution value can change a plurality of payout values), the gaming system links each redistribution value with one payout value (i.e., each redistribution value changes only one payout value). In various other embodiments, the gaming system changes which payout values are linked to which redistribution values during a game session. In one example of a five card draw poker game session embodiment, the gaming system links the Two Pair redistribution value to the Three of a Kind, Straight, Flush, Full House, Four of a Kind, Straight Flush and Royal Flush for a first amount of time during the game session and links the Two Pair redistribution award to Flush, Full House, Four of a Kind, Straight Flush and Royal Flush for a second, remaining amount of time during the game session. It should be appreciated that in various embodiments, the gaming system changes which payout value is linked to which redistribution value multiple times during the game session.

In various other embodiments, for each wagering event in which a determined outcome is associated with a redistribution value, instead of increasing one of the payout values by adding the redistribution value to that payout value, the gaming system increases one of the payout values by a multiplier of the redistribution value. In other embodiments, for each wagering event in which the determined outcome is associated with a redistribution value, instead of the gaming system increasing one of the payout values, the gaming system increases a plurality of the payout values. In one such embodiment, the amount that each payout value is increased is the same. In another embodiment, the amount that each payout value is increased is different. For example, in one embodiment, the gaming system increases the payout values associated with winning outcomes that are less likely to occur (i.e., that are associated with greater payout values, such as a Royal Flush in poker) by a smaller amount than the payout values associated with winning outcomes that are more likely to occur (i.e., that are associated with smaller payout values, such as a Three of a Kind in poker).

In various other embodiments, the gaming system changes at least one winning outcome associated with a redistribution value to a winning outcome associated with a payout value during the game session. In other embodiments, the gaming system changes at least one winning outcome associated with a payout value to a winning outcome associated with a redistribution value during the game session. It other embodiments, the gaming system changes at least one winning outcome associated with a payout value to a winning outcome associated with a redistribution value and changes at least one winning outcome associated with a redistribution value to a winning outcome associated with a payout value during the game session.

In further additional embodiments, the gaming system changes at least one redistribution value associated with a winning outcome during the game session. In other embodiments, the gaming system changes at least one payout value associated with one of the winning outcomes during the game session independent of that payout value changing via a redistribution value. In other embodiments, the gaming system changes both at least one redistribution value and at least one payout value during the game session.

In various other embodiments, the gaming system changes at least one of the values (e.g., redistribution value or payout value) associated with one of the winning outcomes. In one embodiment, the gaming system changes at least one of the values associated with at least one of the winning outcomes based on the amount of time elapsed since the beginning of the game session or the amount of time since a previous wagering event. In another embodiment, the gaming system changes at least one of the values associated with one of the winning outcomes based on the determined portion of the total wager. In other embodiments, the gaming system limits the number of times in which at least one of the values can change during the game session.

In additional embodiments, the gaming system limits the number of times one or more of the redistribution values can be redistributed (e.g., added) to one or more of the payout values.

In various other embodiments, a game session includes a plurality of different designated change outcomes described above. For example, in one embodiment, a game session includes a winning outcomes associated with: (i) a redistribution value, (ii) a payout value, (iii) a subsequent bet increase value, (iv) a time increase value, or (v) any combination of the above values.

In various embodiments, instead of the player controlling an object such as the spaceship, or the player controlling when the cards are dealt to the player, the gaming system randomly selects one or more of the wagering events that occur during the game session. In other embodiments, the determination of which wagering events will occur is randomly determined, determined based on a player's status (such as determined through a player tracking system), determined based on a random determination by the central controller, determined based on a random determination at the gaming device, determined based on one or more side wagers placed, determined based on the player's primary game wager, determined based on time (such as the time of day) or determined based on any other suitable method or criteria.

In various embodiments, the gaming system enables the player to input a particular wager amount and the gaming system determines a corresponding designated period of time for a game session. For example, in one embodiment the gaming system does not display selectable wagering options, but instead requests that the player input a designated total wager amount for a game session and then assigns an amount of time to play the game session based at least in part on the player inputted amount. In various alternative embodiments, the amount of time assigned for a game session is randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day) or determined based on any other suitable method or criteria.

It should be appreciated that instead of the outer space shooting game or the five card draw poker game, the game session could include any suitable type of poker game, slot game, video card game such as blackjack or any other suitable game that includes wagering events. In one embodiment, the game session includes a combination of any such suitable games.

In various embodiments, the gaming system disclosed herein is configured to provide a game session as a wagering primary game base game. In another embodiment, the gaming system disclosed herein is configured to provide a game session as a secondary or bonus game wherein the initial wager is provided by the gaming system.

It should be understood that various changes and modifications to the presently preferred embodiments described herein will be apparent to those skilled in the art. Such changes and modifications can be made without departing from the spirit and scope of the present disclosure and without diminishing its intended advantages. It is therefore intended that such changes and modifications be covered by the appended claims.

The invention is claimed as follows:

1. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) maintain data stored for a plurality of wagering events, each of the plurality of wagering events resulting in any one of a plurality of different outcomes including a plurality of different losing outcomes and a plurality of different winning outcomes, each one of the plurality of different winning outcomes associated with one of a payout value and a redistribution value;

(b) receive a total wager for a game session over a designated period of time; and (c) display a plurality of the wagering events for the game session and for each of the plurality of the wagering events:

(i) determine a portion of the total wager for said wagering event and reduce the total wager by said determined portion of the total wager, (ii) display one of said different outcomes for said wagering event, (iii) if the displayed outcome is one of the winning outcomes associated with one of the redistribution values, increase at least one of the payout values associated with one of the winning outcomes for subsequent wagering events during the game session, said increase based on said redistribution value associated with said displayed winning outcome, and (iv) if the displayed outcome is one of the winning outcomes associated with one of the payout values, provide an award based at least in part on the payout value associated with said displayed winning outcome and the determined portion of the total wager.

2. The gaming system of claim 1, wherein when executed by the at least one processor, the plurality of instructions cause the at least one processor to operate with the at least one display device and the at least one input device to:

(a) if said wagering event is a first wagering event during the game session, determine the portion of the total wager based on the time elapsed since the beginning of the game session, and (b) if said wagering event is not the first wagering event during the game session, determine the portion of the total wager based on the time elapsed since a previous wagering event during the game session.

3. The gaming system of claim 1, wherein each of the plurality of wagering events is a play of a poker game and each of the plurality of different winning outcomes is a different winning hand of the poker game.

4. The gaming system of claim 1, wherein when executed by the at least one processor, the plurality of instructions cause the at least one processor to operate with the at least one display device and the at least one input device to increase said at least one of the payout values associated with one of the winning outcomes by adding the redistribution value to the payout value.

5. The gaming system of claim 1, wherein when executed by the at least one processor, the plurality of instructions cause the at least one processor to operate with the at least one display device and the at least one input device to cause at least one of the values associated with one of the winning outcomes to increase based on one of: (i) an amount of time elapsed since the beginning of the game session, and (ii) an amount of time elapsed since a previous wagering event during the game session.

6. The gaming system of claim 1, wherein when executed by the at least one processor, the plurality of instructions cause the at least one processor to operate with the at least one display device and the at least one input device to cause at least one of the values associated with one of the winning outcomes to increase based on the determined portion of the total wager.

7. The gaming system of claim 1, wherein when executed by the at least one processor, the plurality of instructions cause the at least one processor to operate with the at least one display device and the at least one input device to, for each of the plurality of the wagering events, randomly determine and display one of said different outcomes for said wagering event.

8. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) maintain data stored for a plurality of wagering events, each of the plurality of wagering events resulting in any one of a plurality of different outcomes including a plurality of different winning outcomes and a plurality of different losing outcomes, at least one of the plurality of different winning outcomes associated with a time value;

(b) receive a total wager for a game session over a designated period of time; and (c) display a plurality of the wagering events for the game session and for each of the plurality of the wagering events:

(i) determine a portion of the total wager for said wagering event, (ii) display one of said different outcomes for said wagering event, and (iii) if the displayed outcome is one of the winning outcomes associated with the time value, (A) randomly determine whether to add the time value to the designated period of time for the game session, and (B) if the determination is to add the time value to the designated period of time for the game session, add the time value to the designated period of time for the game session.

9. The gaming system of claim 8, wherein when executed by the at least one processor, the plurality of instructions cause the at least one processor to operate with the at least one display device and the at least one input device to:

(a) if said wagering event is a first wagering event during the game session, determine the portion of the total wager based on the time elapsed since the beginning of the game session, and (b) if said wagering event is not the first wagering event during the game session, determine the portion of the total wager based on the time elapsed since a previous wagering event during the game session.

10. The gaming system of claim 8, wherein the game session is a spaceship game with a plurality of different objects, and each of the plurality of different wagering events is a player shooting at one of the plurality of different objects.

11. The gaming system of claim 8, wherein when executed by the at least one processor, the plurality of instructions cause the at least one processor to operate with the at least one display device and the at least one input device to cause the time value associated with the at least one of the winning outcomes to increase based on one of: (i) an amount of time elapsed since the beginning of the game session, and (ii) an amount of time elapsed since a previous wagering event during the game session.

12. The gaming system of claim 8, wherein when executed by the at least one processor, the plurality of instructions cause the at least one processor to operate with the at least one display device and the at least one input device to cause the time value associated with the at least one of the winning outcomes to increase based on the determined portion of the total wager.

13. The gaming system of claim 8, wherein when executed by the at least one processor, the plurality of instructions cause the at least one processor to operate with the at least one display device and the at least one input device to, if the displayed outcome is one of the winning outcomes associated with the time value, and if the determination is to add the time value to the designated period of time for the game session, add a number of additional wagering credits to the total wager for subsequent wagering events.

14. The gaming system of claim 8, wherein when executed by the at least one processor, the plurality of instructions cause the at least one processor to operate with the at least one display device and the at least one input device to, for each of the plurality of the wagering events, randomly determine and display one of said different outcomes for said wagering event.

15. A gaming system comprising:

at least one display device;

at least one input device;

at least one processor; and at least one memory device which stores a plurality of instructions, which when executed by the at least one processor, cause the at least one processor to operate with the at least one display device and the at least one input device to:

(a) maintain data stored for a plurality of wagering events, each of the plurality of wagering events resulting in any one of a plurality of different outcomes including a plurality of different losing outcomes and a plurality of different winning outcomes, at least one of the plurality of different winning outcomes associated with a subsequent bet increase value, (b) receive a total wager for a game session over a designated period of time; and (c) display a plurality of the wagering events for the game session and for each of the plurality of the wagering events:

(i) determine a portion of the total wager for said wagering event, (ii) display one of said different outcomes for said wagering event, and (iii) if the displayed outcome is one of the winning outcomes associated with the subsequent bet increase value, (A) randomly determine whether to add the subsequent bet increase value to one of the total wager and the determined portion of the total wager for subsequent wagering events, and (B) if the determination is to add the subsequent bet increase value to one of the total wager and the determined portion of the total wager, add the subsequent bet increase value to one of the total wager and the determined portion of the total wager for subsequent wagering events.

16. The gaming system of claim 15, wherein the game session is a spaceship game with a plurality of different assets, and each of the plurality of different wagering events is a player shooting at one of the plurality of different assets.

17. The gaming system of claim 15, wherein at least one of the winning outcomes is associated with a credit value, and wherein when executed by the at least one processor, the plurality of instructions cause the at least one processor to operate with the at least one display device and the at least one input device to, if the displayed outcome is one of the winning outcomes associated with a credit value, randomly determine whether to provide an award based at least in part on the credit value and the determined portion of the total wager.

18. The gaming system of claim 15, wherein when executed by the at least one processor, the plurality of instructions cause the at least one processor to operate with the at least one display device and the at least one input device to cause the subsequent bet increase values associated with the at least one of the winning outcomes to increase based on one of: (i) an amount of time elapsed since the beginning of the game session or (ii) an amount of time elapsed since a previous wagering event during the game session.

19. The gaming system of claim 15, wherein when executed by the at least one processor, the plurality of instructions cause the at least one processor to operate with the at least one display device and the at least one input device to cause the subsequent bet increase value associated with one of the winning outcomes to increase based on the determined portion of the total wager.

20. The gaming system of claim 1, wherein when executed by the at least one processor, the plurality of instructions cause the at least one processor to operate with the at least one display device and the at least one input device to, for each of the plurality of the wagering events, randomly determine and display one of said different outcomes for said wagering event.

* * * * *

UNITED STATES PATENT AND TRADEMARK OFFICE

CERTIFICATE OF CORRECTION

PATENT NO. : 8,308,550 B2
APPLICATION NO. : 12/774048
DATED : November 13, 2012
INVENTOR(S) : Cameron A. Filipour et al.

It is certified that error appears in the above-identified patent and that said Letters Patent is hereby corrected as shown below:

IN THE CLAIMS

In Claim 2, Column 32, Line 49, delete the first instance of "the" and replace the second instance of "the" with --a--.
In Claim 2, Column 32, Line 53, delete "the".
In Claim 4, Column 32, Line 65, replace "the" with --said at least one of the-- and replace "value" with --values--.
In Claim 5, Column 33, Line 2, between "cause" and "at" insert --said--.
In Claim 5, Column 33, Line 3, between "the" and "values" insert --payout--.
In Claim 5, Column 33, Line 5, replace the first instance of "the" with --a--.
In Claim 6, Column 33, Line 11, between "cause" and "at" insert --said--.
In Claim 6, Column 33, Line 12, between "the" and "values" insert --payout--.
In Claim 9, Column 33, Line 62, delete the first instance of "the" and replace the second instance of "the" with --a--.
In Claim 9, Column 33, Line 66, delete "the".
In Claim 11, Column 34, Line 12, replace "the beginning" with --beginning--.
In Claim 17, Column 35, Line 19, replace "a" with --the--.
In Claim 18, Column 36, Line 3, replace "values" with --value--.
In Claim 18, Column 36, Line 5, replace "the" with --a--.
In Claim 18, Column 36, Line 6, delete "or".
In Claim 19, Column 36, Line 12, between "with" and "one" insert --the at least--.

Signed and Sealed this
Eighth Day of January, 2013

David J. Kappos

David J. Kappos
*Director of the United States Patent and Trademark Office*